US010269313B2

(12) United States Patent
Harada et al.

(10) Patent No.: US 10,269,313 B2
(45) **Date of Patent: *Apr. 23, 2019**

(54) DISPLAY DEVICE AND DISPLAY DEVICE DRIVE METHOD

(71) Applicant: Japan Display Inc., Tokyo (JP)

(72) Inventors: Tsutomu Harada, Tokyo (JP); Naoyuki Takasaki, Tokyo (JP); Akira Sakaigawa, Tokyo (JP); Amane Higashi, Tokyo (JP)

(73) Assignee: Japan Display Inc., Tokyo (JP)

( * ) Notice: Subject to any disclaimer, the term of this patent is extended or adjusted under 35 U.S.C. 154(b) by 36 days.

This patent is subject to a terminal disclaimer.

(21) Appl. No.: 15/492,640

(22) Filed: Apr. 20, 2017

(65) Prior Publication Data

US 2017/0221433 A1 Aug. 3, 2017

Related U.S. Application Data

(63) Continuation of application No. 14/668,324, filed on Mar. 25, 2015, now Pat. No. 9,659,531.

(30) Foreign Application Priority Data

Mar. 27, 2014 (JP) ..... 2014-065803

(51) Int. Cl.
*G09G 3/36* (2006.01)
*G09G 3/34* (2006.01)

(52) U.S. Cl.
CPC ..... *G09G 3/3607* (2013.01); *G09G 3/342* (2013.01); *G09G 3/3413* (2013.01);
(Continued)

(58) Field of Classification Search
CPC ..... G09G 3/3607
(Continued)

(56) References Cited

U.S. PATENT DOCUMENTS 9,659,531 B2 * 5/2017 Harada ..... G09G 3/3413
2009/0085847 A1 4/2009 Morisue et al.
(Continued)

FOREIGN PATENT DOCUMENTS

JP 2011-181635 A1 7/2011
JP 2011-248352 A 12/2011
JP 2012-053489 A 3/2012

OTHER PUBLICATIONS

Chinese Office Action dated Dec. 2, 2016 for corresponding Chinese Patent Application No. 201510140512.2.

*Primary Examiner* — Long D Pham
(74) *Attorney, Agent, or Firm* — Michael Best & Friedrich LLP

(57) ABSTRACT

In a display device, pixels each including first to fourth subpixels that respectively display first to third primary colors and fourth color are arranged on an image display panel. A lighting unit emits light to the panel from the rear thereof. A control unit calculates a required luminance value for each block of the display surface of the panel based on an input image signal, determines a light source lighting amount of the lighting unit based on luminance distribution information on the lighting unit so as to satisfy the required luminance value, generates luminance information on each pixel based on the luminance distribution information and light source lighting amount, generates an output image signal that drives the subpixels based on the luminance information and input image signal, controls the lighting unit by the light source lighting amount, and controls the panel by the output image signal.

8 Claims, 20 Drawing Sheets

(52) U.S. Cl.
CPC ... *G09G 3/3648* (2013.01); *G09G 2300/0439* (2013.01); *G09G 2300/0443* (2013.01); *G09G 2300/0452* (2013.01); *G09G 2320/0233* (2013.01); *G09G 2320/0646* (2013.01); *G09G 2330/021* (2013.01); *G09G 2360/16* (2013.01)

(58) Field of Classification Search
USPC ..... 345/694
See application file for complete search history.

(56) References Cited

U.S. PATENT DOCUMENTS

| | | | |
|---|---|---|---|
| 2009/0322802 | A1 | 12/2009 | Noguchi et al. |
| 2010/0007679 | A1 | 1/2010 | Sakaigawa |
| 2010/0259556 | A1 | 10/2010 | Inuzuka |
| 2011/0181635 | A1 | 7/2011 | Kabe et al. |
| 2011/0267381 | A1 | 11/2011 | Yamazaki et al. |

* cited by examiner

270 REQUIRED LUMINANCE VALUE INFORMATION

| N \ M | 1 | 2 | 3 |
|---|---|---|---|
| 1 | 4.0 | 4.0 | 4.0 |
| 2 | 4.0 | 4.0 | 4.0 |
| 3 | 4.0 | 4.0 | 4.0 |
| 4 | 4.0 | 4.0 | 4.0 |
| 5 | 2.0 | 2.0 | 2.0 |
| 6 | 3.0 | 1.5 | 4.0 |
| 7 | 2.0 | 1.5 | 2.0 |
| 8 | 2.0 | 1.2 | 1.8 |
| 9 | 1.5 | 1.2 | 1.7 |

FIG. 12

280 LIGHTING PATTERN
(LIGHT SOURCE LIGHTING AMOUNT)

| LIGHT SOURCE | LIGHTING AMOUNT |
|---|---|
| 56A | 64 |
| 56B | 119 |
| 56C | 71 |
| 56D | 68 |
| 56E | 71 |
| 56F | 137 |
| 56G | 192 |
| 56H | 208 |
| 56I | 137 |
| 56J | 64 |

FIG. 14

DISPLAY DEVICE AND DISPLAY DEVICE DRIVE METHOD

CROSS-REFERENCE TO RELATED APPLICATION

This is a Continuation application of U.S. patent application Ser. No. 14/668,324, filed Mar. 25, 2015, which in turn claims priority from Japanese Patent Application No. 2014-065803, filed on Mar. 27, 2014, the entire contents of which are incorporated herein by reference.

FIELD

The embodiments discussed herein are related to a display device and a display device drive method.

BACKGROUND

In recent years, for example, the screen definition of display devices has become higher and the color reproduction ranges of display devices have become larger. The power consumption of such high performance display devices increases. For example, to solve this problem, there has been known the technique of forming a pixel of four subpixels obtained by adding a fourth subpixel which displays a fourth color to a first subpixel which displays a first primary color, a second subpixel which displays a second primary color, and a third subpixel which displays a third primary color. With this technique the fourth subpixel increases luminance. This makes it possible to decrease the luminance of a backlight. As a result, power consumption is reduced. Furthermore, the technique of controlling the luminance of a backlight according to an input image signal for reducing power consumption further is known (see, for example, Japanese Laid-open Patent Publication No. 2011-248352).

SUMMARY

There are provided a display device and a display device drive method which reduce power consumption. Alternatively, there are provided a display device and a display device drive method which improve image quality.

According to an aspect, there is provided a display device including: an image display panel including a plurality of pixels each including a first subpixel which displays a first primary color, a second subpixel which displays a second primary color, a third subpixel which displays a third primary color, and a fourth subpixel which displays a fourth color; a lighting unit which emits light to the image display panel from a rear of the image display panel; and a control unit which calculates a required luminance value for each of blocks obtained by dividing a display surface of the image display panel on the basis of an input image signal, which determines a light source lighting amount of the lighting unit on the basis of luminance distribution information on the lighting unit stored in advance so as to satisfy the required luminance value, which generates luminance information on each pixel on the basis of the luminance distribution information and the light source lighting amount, which generates an output image signal which drives the first subpixel, the second subpixel, the third subpixel, and the fourth subpixel on the basis of the luminance information and the input image signal, which controls the lighting unit by the light source lighting amount, and which controls the image display panel by the output image signal.

The object and advantages of the invention will be realized and attained by means of the elements and combinations particularly pointed out in the claims.

It is to be understood that both the foregoing general description and the following detailed description are exemplary and explanatory and are not restrictive of the invention.

BRIEF DESCRIPTION OF DRAWINGS

FIG. 12 illustrates an example of a required luminance value for each block in the second embodiment;

FIG. 14 illustrates an example of a lighting pattern in the second embodiment;

DESCRIPTION OF EMBODIMENTS

Figure 1:
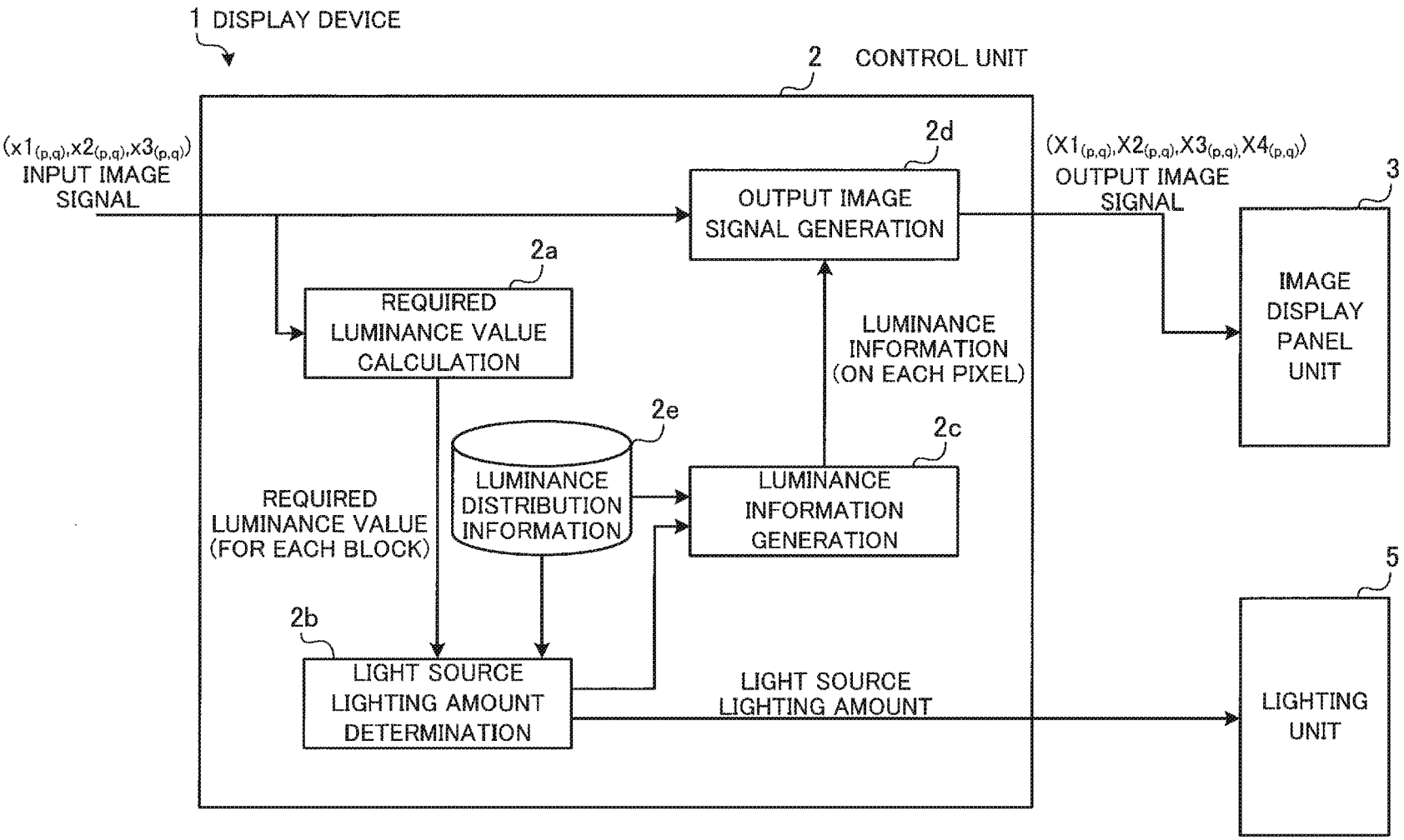
FIG. 1 illustrates an example of the structure of a display device according to a first embodiment.

Embodiments will now be described with reference to the accompanying drawings.

Disclosed embodiments are simple examples. It is a matter of course that a proper change which suits the spirit of the invention and which will readily occur to those skilled in the art falls within the scope of the present invention. Furthermore, in order to make description clearer, the width, thickness, shape, or the like of each component may schematically be illustrated in the drawings compared with the actual state. However, it is a simple example and the interpretation of the present invention is not restricted.

In addition, in the present invention and the drawings the same components that have already been described in previous drawings are marked with the same numerals and detailed descriptions of them may be omitted according to circumstances.

(First Embodiment)

A display device according to a first embodiment will be described by the use of FIG. 1. FIG. 1 illustrates an example of the structure of a display device according to a first embodiment. A display device 1 illustrated in FIG. 1 includes a control unit 2, an image display panel unit 3, and a lighting unit 5.

The control unit 2 receives an input image signal from the outside, controls the luminance of the lighting unit 5 which lights the image display panel unit 3 and image display by the image display panel unit 3, and displays an image of the input image signal.

The image display panel unit 3 includes pixels arranged in a matrix of Q columns and P rows, each of which includes a first subpixel which displays a first primary color, a second subpixel which displays a second primary color, a third subpixel which displays a third primary color, and a fourth subpixel which displays a fourth color. For example, the first primary color is red, the second primary color is green, and the third primary color is blue. The fourth color is a color which contributes to an increase in the luminance of a pixel, and is, for example, white or yellow. The operation of each subpixel is controlled by an output image signal.

The lighting unit 5 is a backlight which emits light from the rear of the image display panel unit 3, and emits white light to the display surface of the image display panel unit 3. The lighting unit 5 adjusts a light source lighting amount of a light source. By doing so, division drive control by which luminance is controlled according to areas is performed. For example, a plurality of light sources which operate independently of one another are used and division drive control of luminance is performed by their lighting patterns. Division drive control may be performed by arranging between the light sources and the image display panel unit 3 a plurality of adjustment units each of which adjusts the amount of the light of a light source that reaches the image display panel unit 3. In this case, a light source lighting amount may be kept constant. A case where the lighting unit 5 includes a plurality of light sources will now be described. However, an adjustment amount by each adjustment unit is determined in the same way.

Processes performed by the control unit 2 will be described. The control unit 2 performs required luminance value calculation 2*a* , light source lighting amount determination 2*b* , luminance information generation 2*c* , and output image signal generation 2*d*.

Description will be given in order of process. An input image signal inputted to the control unit 2 includes an input signal value $x1_{(p,q)}$ for the first primary color, an input signal value $x2_{(p,q)}$ for the second primary color, and an input signal value $x3_{(p,q)}$ for the third primary color. "p" and "q" are integers which satisfy $1 \le p \le P$ and $1 \le q \le Q$ respectively.

In the required luminance value calculation 2*a* a required luminance value is calculated for each of the blocks obtained by dividing the display surface of the image display panel unit 3 on the basis of an input image signal. As stated above, the input image signal includes an input signal value $x1_{(p,q)}$ for the first primary color, an input signal value $x2_{(p,q)}$ for the second primary color, and an input signal value $x3_{(p,q)}$ for the third primary color. When an image of the input image signal is reproduced on each pixel of the image display panel unit 3 including the fourth subpixel, an increase in the luminance of the image is realized. Furthermore, the luminance of the lighting unit 5 can be reduced according to the increase in the luminance of the image. In the required luminance value calculation 2*a* the lowest luminance of the lighting unit 5 that enables color reproduction is found for all pixels each including the fourth subpixel in each block. By doing so, a required luminance value is calculated.

In the light source lighting amount determination 2*b* a light source lighting amount which satisfies a required luminance value for each block is determined on the basis of luminance distribution information 2*e* stored in advance in a storage unit. The lighting unit 5 includes a plurality of light sources which operate independently of one another. Luminance information on the lighting unit 5 at the time of lighting each light source in advance at a determined amount of light is stored in the luminance distribution information 2*e* . In the light source lighting amount determination 2*b* a lighting amount of each light source is adjusted so as to satisfy a required luminance value for each block, and a lighting pattern is determined.

In the luminance information generation 2*c* luminance information on the lighting unit 5 for each pixel is generated on the basis of the luminance distribution information 2*e* and a light source lighting amount. To be concrete, luminance distribution information on the lighting unit 5 at the time of driving the lighting unit 5 at a light source lighting amount determined by the use of the luminance distribution information 2*e* is calculated. When the calculated luminance distribution information is not indicated on a pixel-by-pixel basis, the calculated luminance distribution information is converted to pixel-by-pixel information. By doing so, luminance information for each pixel on the lighting unit 5 is obtained.

In the output image signal generation 2*d* an output image signal is generated for each pixel on the basis of luminance information on the lighting unit 5 for the pixel and the input image signal. The output image signal includes an output signal value $X1_{(p,q)}$ corresponding to the first subpixel, an output signal value $X2_{(p,q)}$ corresponding to the second subpixel, an output signal value $X3_{(p,q)}$ corresponding to the third subpixel, and an output signal value $X4_{(p,q)}$ corresponding to the fourth subpixel. As stated above, the first subpixel displays the first primary color, the second subpixel displays the second primary color, the third subpixel displays the third primary color, and the fourth subpixel displays the fourth color. Accordingly, the output signal value $X1_{(p,q)}$ the output signal value $X2_{(p,q)}$, the output signal value $X3_{(p,q)}$, and the output signal value $X4_{(p,q)}$ included in the output image signal correspond to the first primary color, the second primary color, the third primary color, and the fourth color respectively.

As stated above, the luminance of the lighting unit 5 can be reduced according to an increase in the luminance of an image. There is such a correspondence between the luminance of an image and the luminance of the lighting unit 5. Accordingly, display is performed more properly by generating an output image signal in which luminance information on the lighting unit 5 calculated for each pixel is reflected.

With the display device 1 a light source lighting amount of the lighting unit 5 is determined so as to satisfy a required luminance value for each block calculated by the use of an input image signal. As a result, the luminance of the lighting unit 5 can be reduced for a block in which the luminance of an image is low. This leads to a reduction in power consumption. Furthermore, luminance information on the lighting unit 5 corresponding to the determined light source lighting amount is found for each pixel and an output image signal in which the luminance information on the lighting unit 5 found for each pixel is reflected is determined. As a result, the luminance of the lighting unit 5 matches the output image signal on a pixel-by-pixel basis and image quality improves.

(Second Embodiment)

A display device according to a second embodiment will now be described. First the structure of a display device will be described, and then a display control process performed by the display device will be described.

Figure 2:
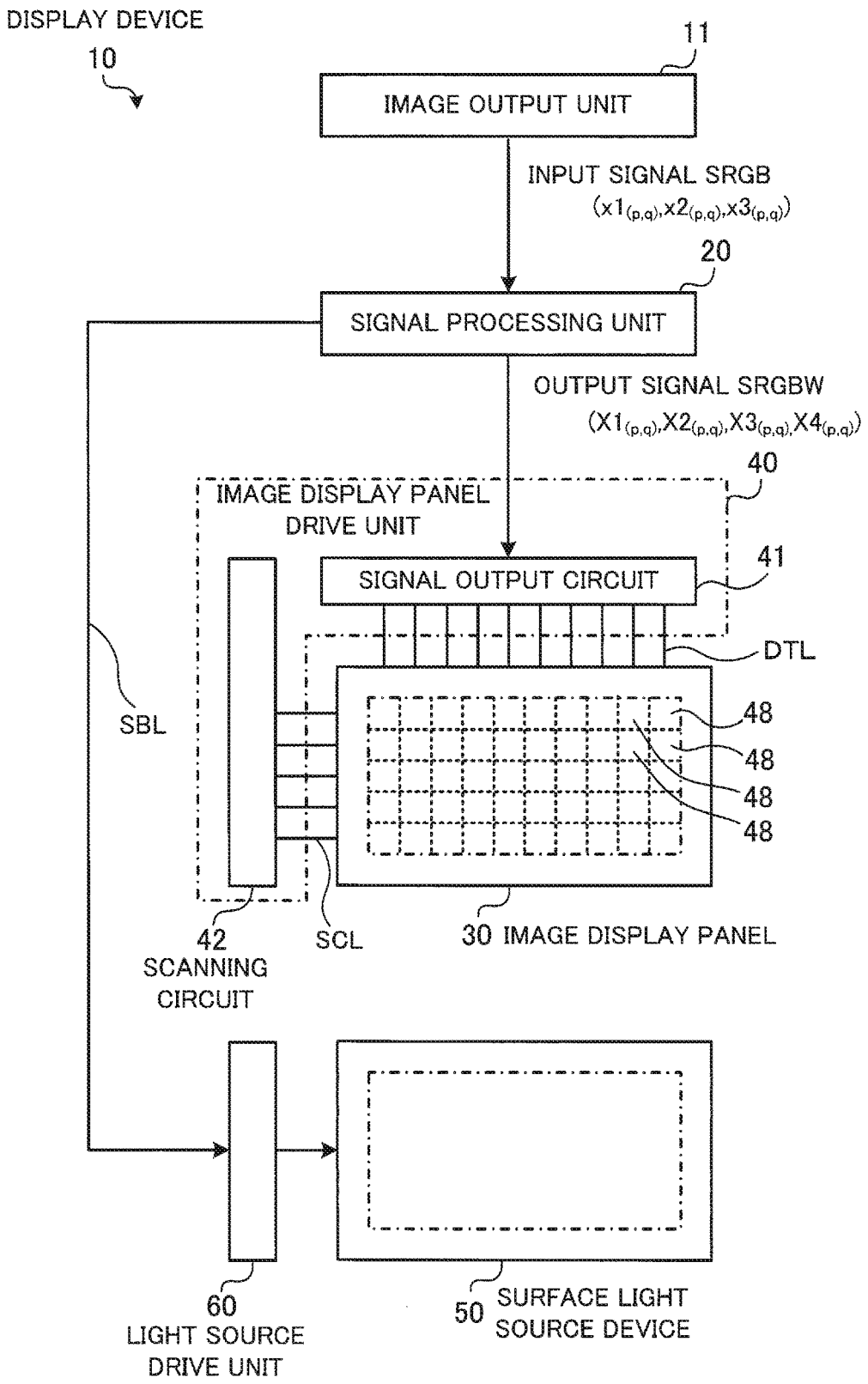
FIG. 2 illustrates an example of the structure of a display device according to a second embodiment.

FIG. 2 illustrates an example of the structure of a display device according to a second embodiment.

A display device 10 illustrated in FIG. 2 includes an image output unit 11, a signal processing unit 20, an image display panel 30, an image display panel drive unit 40, a surface light source device 50, and a light source drive unit 60. The display device 10 is an embodiment of the display device 1 illustrated in FIG. 1.

The image output unit 11 outputs an input signal SRGB to the signal processing unit 20. The input signal SRGB includes an input signal value $x1_{(p,q)}$ for a first primary color, an input signal value $x2_{(p,q)}$ for a second primary color, and an input signal value $x3_{(p,q)}$ for a third primary color. In the second embodiment it is assumed that the first primary color is red, the second primary color is green, and the third primary color is blue.

The signal processing unit 20 is connected to the image display panel drive unit 40 which drives the image display panel 30 and the light source drive unit 60 which drives the surface light source device 50. The signal processing unit 20 division-controls the luminance of the surface light source device 50 for each block. Furthermore, the signal processing unit 20 calculates luminance information for each pixel on the surface light source device 50 and generates an output signal SRGBW in which it is reflected. By doing so, the signal processing unit 20 controls image display. In addition to an output signal value $X1_{(p,q)}$ corresponding to a first subpixel, an output signal value $X2_{(p,q)}$ corresponding to a second subpixel, and an output signal value $X3_{(p,q)}$ corresponding to a third subpixel, the output signal SRGBW includes an output signal value $X4_{(p,q)}$ corresponding to a fourth subpixel which displays a fourth color. In the second embodiment it is assumed that the fourth color is white. The signal processing unit 20 is an embodiment of the control unit 2.

The image display panel 30 is made up of (P×Q) pixels 48 arranged in a two-dimensional matrix. The image display panel drive unit 40 includes a signal output circuit 41 and a scanning circuit 42 and drives the image display panel 30. The image display panel 30 and the image display panel drive unit 40 are an embodiment of the image display panel unit 3.

The surface light source device 50 is arranged on the rear side of the image display panel 30 and emits light to the image display panel 30. By doing so, the surface light source device 50 lights the image display panel 30. The light source drive unit 60 controls the luminance of the surface light source device 50 on the basis of a light source control signal SBL outputted from the signal processing unit 20. The surface light source device 50 and the light source drive unit 60 are an example of the lighting unit 5.

The image display panel 30 and the surface light source device 50 will now be described by the use of FIGS. 3 and 4 respectively.

The image display panel 30 will be described first. FIG. 3 illustrates an example of the arrangement of pixels on the image display panel in the second embodiment.

Figure 3:
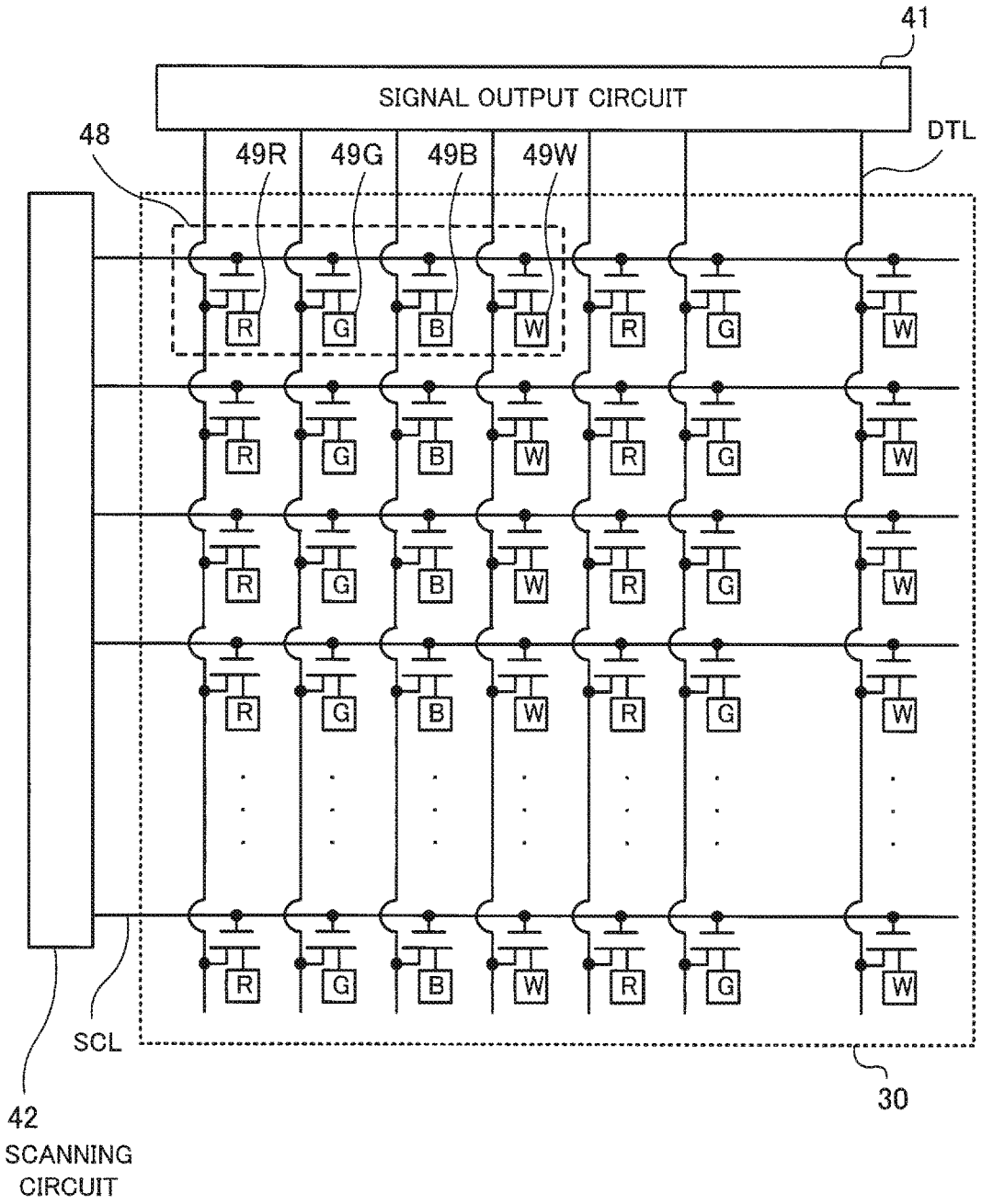
FIG. 3 illustrates an example of the arrangement of pixels on an image display panel in the second embodiment.

With the image display panel 30 illustrated in FIG. 3, each of the pixels 48 arranged in a two-dimensional matrix includes a first subpixel 49R, a second subpixel 49G, a third subpixel 49B, and a fourth subpixel 49W. In the second embodiment, the first subpixel 49R displays red, the second subpixel 49G displays green, the third subpixel 49B displays blue, and the fourth subpixel 49W displays white. However, colors which the first subpixel 49R, the second subpixel 49G, and the third subpixel 49B display are not limited to them. The first subpixel 49R, the second subpixel 49G, and the third subpixel 49B may display other different colors. For example, the first subpixel 49R, the second subpixel 49G, and the third subpixel 49B may display the complementary colors of red, green, and blue respectively. Furthermore, a color which the fourth subpixel 49W displays is not limited to white. For example, the fourth subpixel 49W may display yellow. However, white is effective in reducing power consumption. It is desirable that if a light source lights the first subpixel 49R, the second subpixel 49G, the third subpixel 49B, and the fourth subpixel 49W at the same light source lighting amount, the fourth subpixel 49W is brighter than the first subpixel 49R, the second subpixel 49G, and the third subpixel 49B. If there is no need to distinguish among the first subpixel 49R, the second subpixel 49G, the third subpixel 49B, and the fourth subpixel 49W, then the term "subpixels 49" will be employed in the following description.

More specifically, the image display panel 30 is a transmission type color liquid crystal display panel. Color filters which transmit red light, green light, and blue light are disposed between the first subpixel 49R, the second subpixel 49G, and the third subpixel 49B, respectively, and an observer of an image. Furthermore, a color filter is not disposed between the fourth subpixel 49W and an observer of an image. The fourth subpixel 49W may include a transparent resin layer in place of a color filter. If a color filter is not disposed between the fourth subpixel 49W and an observer of an image, a great difference in level arises between the fourth subpixel 49W and the first subpixel 49R, the second subpixel 49G, and the third subpixel 49B. The formation of a transparent resin layer prevents a great difference in level from arising between the fourth subpixel 49W and the first subpixel 49R, the second subpixel 49G, and the third subpixel 49B.

The signal output circuit 41 and the scanning circuit 42 included in the image display panel drive unit 40 are electrically connected to the subpixels 49R, 49G, 49B, and 49W of the image display panel 30 via signal lines DTL and signal lines SCL respectively. The subpixels 49 are connected not only to the signal lines DTL but also to the signal lines SCL via switching elements (such as TFTs (Thin Film Transistors)). The image display panel drive unit 40 selects subpixels 49 by the scanning circuit and outputs image signals in order from the signal output circuit 41. By doing so, the image display panel drive unit 40 controls the operation (light transmittance) of the subpixels 49.

Next, the surface light source device 50 will be described by the use of FIG. 4. FIG. 4 illustrates an example of the structure of the surface light source device in the second embodiment.

Figure 4:
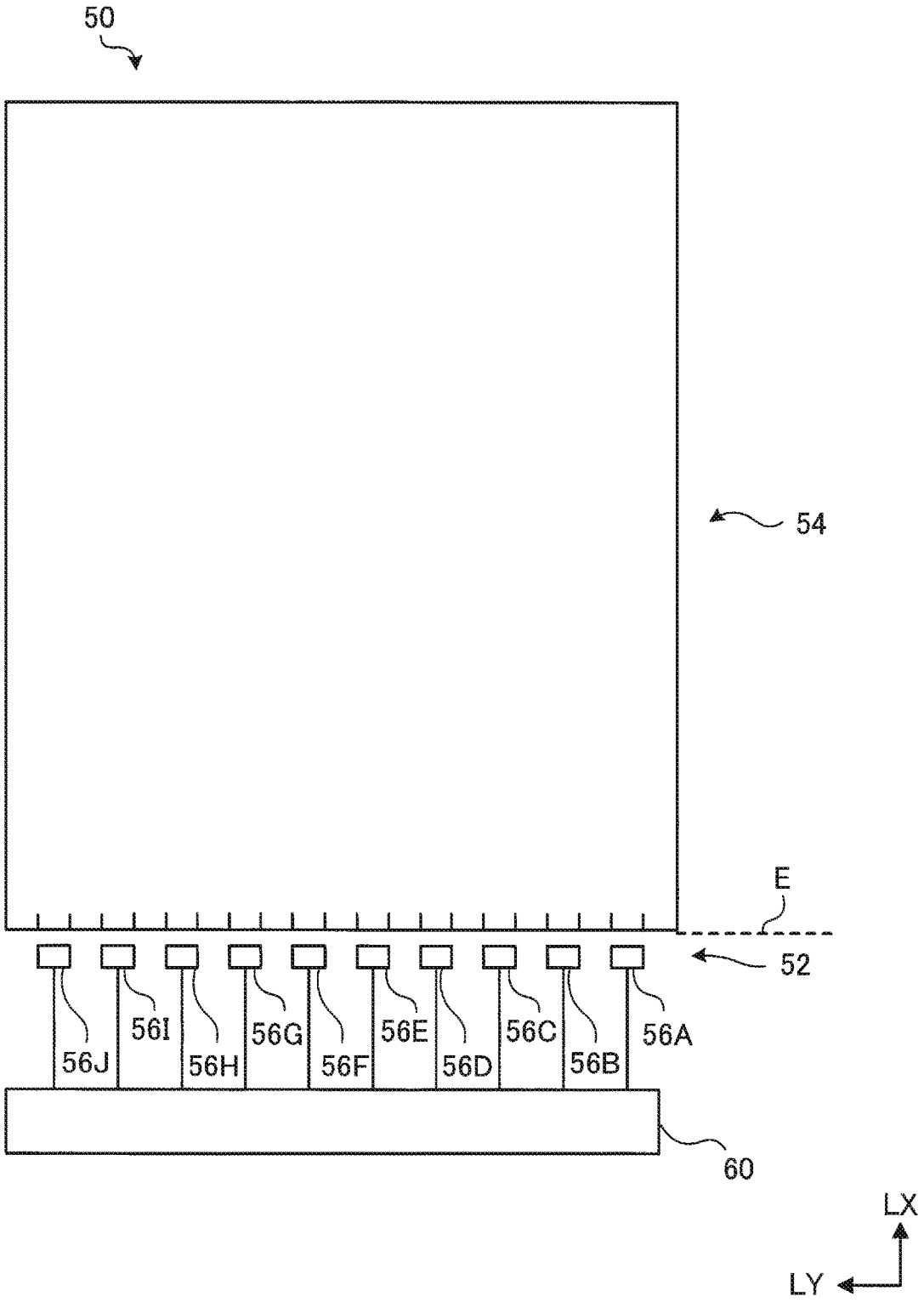
FIG. 4 illustrates an example of the structure of a surface light source device in the second embodiment.

The surface light source device 50 illustrated in FIG. 4 includes a light guide plate 54 and a sidelight light source 52 in which light sources 56A, 56B, 56C, 56D, 56E, 56F, 56G, 56H, 56I, and 56J are arranged opposite an incident surface E that is at least one side of the light guide plate 54. The light sources 56A, 56B, 56C, 56D, 56E, 56F, 56G, 56H, 56I, and 56J are LEDs (Light-Emitting Diodes) which emit light of the same color (white, for example), and control current values or duty ratios independently of one another. If there is no need to distinguish among the light sources 56A, 56B, 56C, 56D, 56E, 56F, 56G, 56H, 56I, and 56J, then the term "light sources 56" will be employed in the following description. The light sources 56 are arranged along the one side of the light guide plate 54. It is assumed that the direction in which the light sources 56 are arranged is a light source arrangement direction LY. Light emitted from the light sources 56 is inputted from the incident surface E to the light guide plate 54 in an incident direction LX perpendicular to the light source arrangement direction LY.

The light source drive unit 60 adjusts the values of current supplied to the light sources 56 or duty ratios on the basis of a light source control signal SBL outputted from the signal processing unit 20. By doing so, the light source drive unit 60 controls the amount of the light of the light sources 56 and controls the luminance (intensity of the light) of the surface light source device 50.

Lights which are inputted from the light sources 56 and which are emitted from the light guide plate 54 to the rear of the image display panel 30 have different luminance distributions according to the positions at which the light sources 56 are arranged. The luminance distribution of light on which each light source 56 acts will be described by the use of FIGS. 5 and 6.

Figure 5:
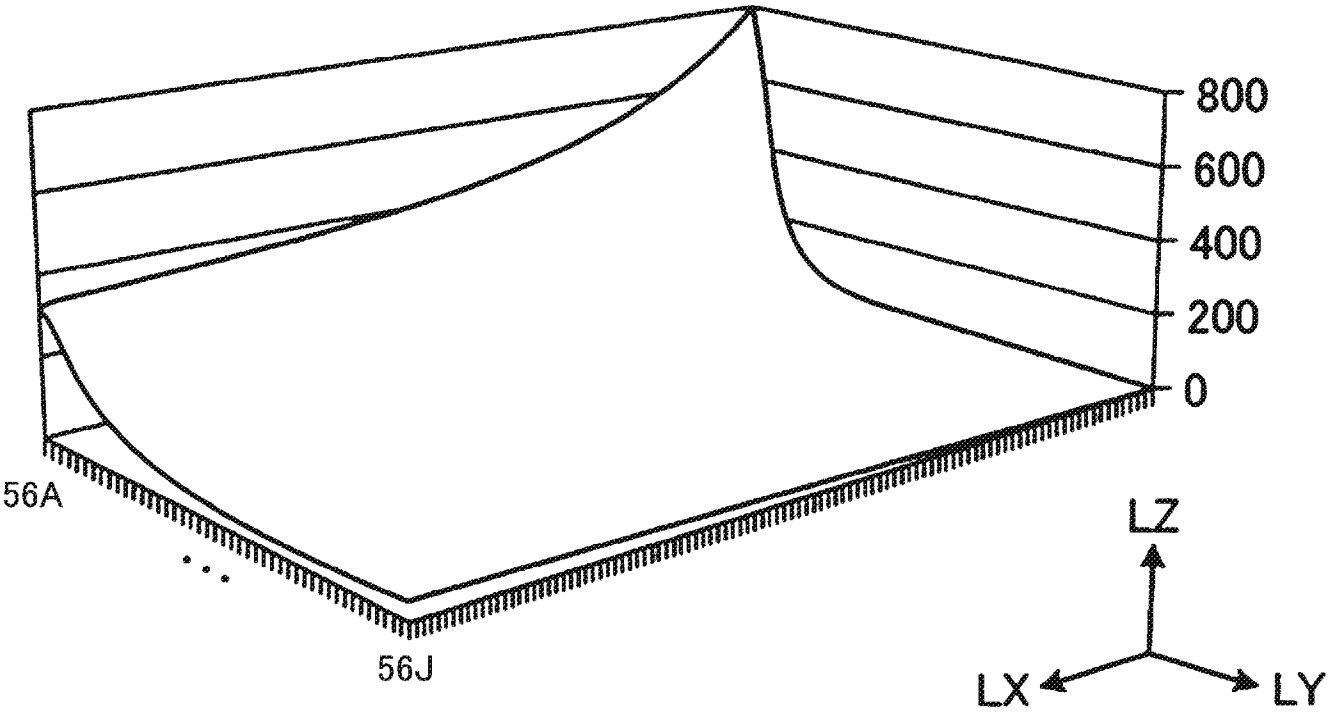
FIG. 5 illustrates an example of the luminance distribution of light on which one light source of a sidelight light source acts.

FIG. 5 illustrates an example of the luminance distribution of light on which one light source of the sidelight light source acts. FIG. 5 illustrates the distribution of the intensity of light which is inputted from the light source 56A and which is emitted from the light guide plate 54 to the rear of the image display panel 30 in the case of only the light source 56A lighting. As illustrated in FIG. 4, the light source 56A is arranged at the end of the sidelight light source 52. LX in FIG. 5 indicates a direction in which light is inputted from each light source of the sidelight light source 52. LY perpendicular to the incident direction LX indicates a light source arrangement direction of the sidelight light source 52. LZ perpendicular to the incident direction LX and the light source arrangement direction LY indicates a direction in which the image display panel 30 is lighted from the rear. When light emitted from the light source 56A is inputted from the incident surface E to the light guide plate 54, the light guide plate 54 emits light in the lighting direction LZ.

Figure 6:
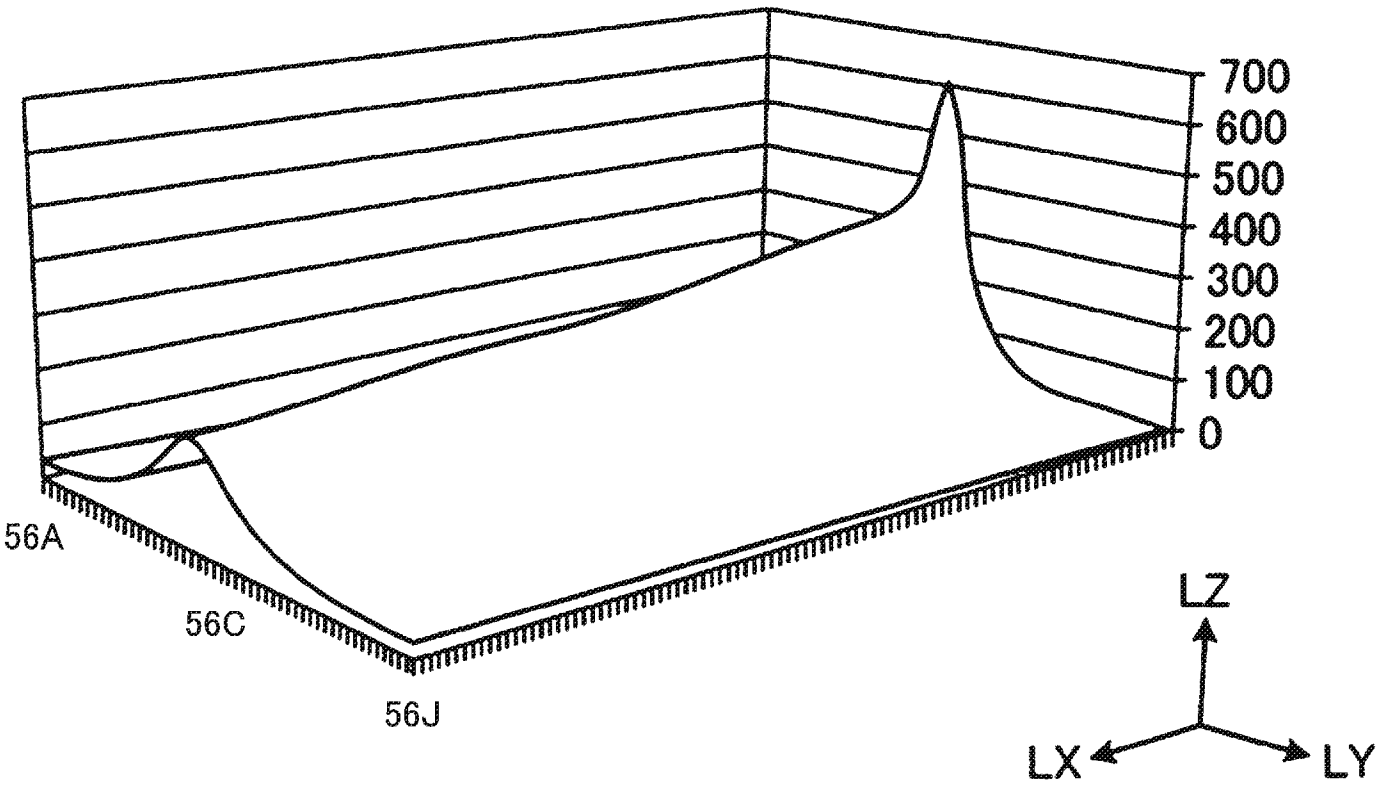
FIG. 6 illustrates an example of the luminance distribution of light on which another light source of the sidelight light source acts.

FIG. 6 illustrates an example of the luminance distribution of light on which another light source of the sidelight light source acts. FIG. 6 illustrates the distribution of the intensity of light which is inputted from the light source 56C and which is emitted from the light guide plate 54 to the rear of the image display panel 30 in the case of only the light source 56C lighting. As illustrated in FIG. 4, the light source 56C is arranged between the light sources 56A and 56J which are arranged at both ends of the sidelight light source 52. When light emitted from the light source 56C is inputted from the incident surface E to the light guide plate 54, the light guide plate 54 emits light in the lighting direction LZ.

Both ends of the light guide plate 54 which appear in the light source arrangement direction LY reflect light. As a result, the luminance distribution of FIG. 5 realized by the light source 56A near both ends of the light guide plate 54 which appear in the light source arrangement direction LY and the luminance distribution of FIG. 6 realized by the light source 56C arranged between the light sources 56A and 56J, which are arranged at both ends of the sidelight light source 52, differ. The signal processing unit 20 considers that luminance distributions realized by the light sources 56 differ, and controls a lighting amount of each light source 56.

Figure 7:
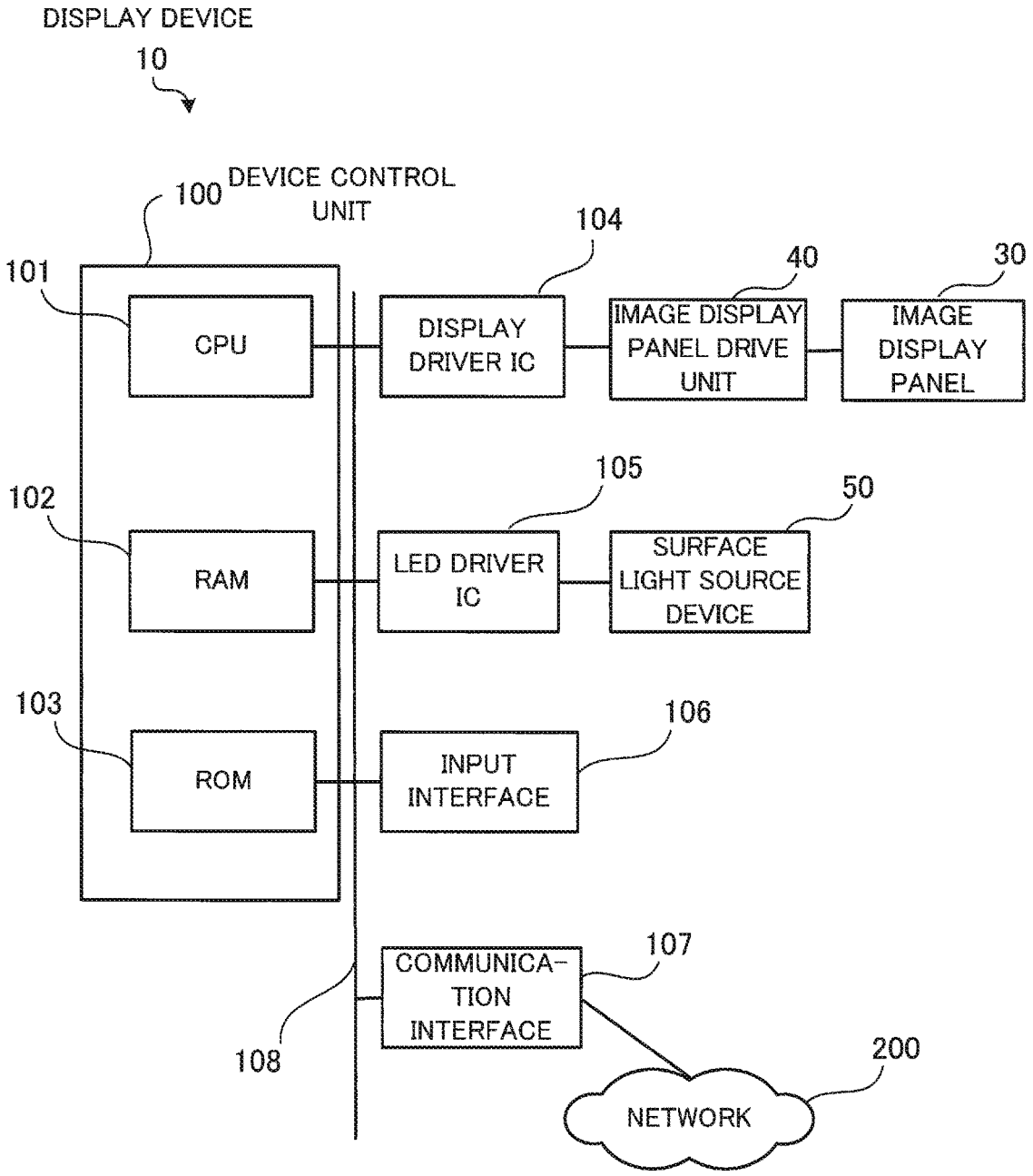
FIG. 7 illustrates an example of the hardware configuration of the display device according to the second embodiment.

The hardware configuration of the display device 10 will now be described. FIG. 7 illustrates an example of the hardware configuration of the display device according to the second embodiment.

The whole of the display device 10 is controlled by a device control unit 100. The device control unit 100 includes a CPU (Central Processing Unit) 101. A RAM (Random Access Memory) 102, a ROM (Read Only Memory) 103, and a plurality of peripheral units are connected to the CPU 101 via a bus 108.

The RAM 102 is used as main storage of the device control unit 100. The RAM 102 temporarily stores at least a part of an OS (Operating System) program or an application program executed by the CPU 101. In addition, the RAM 102 stores various pieces of data which the CPU 101 needs to perform a process.

The ROM 103 is a read only semiconductor memory and stores an OS program, an application program, and fixed data which is not rewritten. Furthermore, a semiconductor memory, such as a flash memory, may be used as auxiliary storage in place of the ROM 103 or in addition to the ROM 103.

The CPU 101 controls the whole of the display device 10 on the basis of an OS program and an application program stored in the ROM 103 and various pieces of data expanded in the RAM 102. When the CPU 101 performs a process, the CPU 101 may operate by an OS program or an application program temporarily stored in the RAM 102.

The plurality of peripheral units connected to the bus 108 are a display driver IC (Integrated Circuit) 104, an LED driver IC 105, an input interface 106, and a communication interface 107.

The image display panel 30 is connected to the display driver IC 104 via the image display panel drive unit 40. The display driver IC 104 outputs an output signal SRGBW to the image display panel drive unit 40. The image display panel drive unit 40 outputs a control signal corresponding to the output signal SRGBW to display an image on the image display panel 30.

The surface light source device 50 is connected to the LED driver IC 105. The LED driver IC 105 drives the light sources 56 according to a light source control signal SBL and controls the luminance of the surface light source device 50. The LED driver IC 105 realizes at least a part of the function of the light source drive unit 60.

An input device used for inputting user's instructions is connected to the input interface 106. An input device, such as a keyboard, a mouse used as a pointing device, or a touch panel, is connected. The input interface 106 transmits to the CPU 101 a signal transmitted from the input device.

The communication interface 107 is connected to a network 200. The communication interface 107 transmits data to or receives data from another computer or a communication apparatus via the network 200.

By adopting the above hardware configuration, the processing functions in the second embodiment are realized.

The processing operation of the signal processing unit 20 is realized by the display driver IC 104 or the CPU 101.

If the processing operation of the signal processing unit 20 is realized by the display driver IC 104, then an input signal SRGB is inputted via the CPU 101 to the display driver IC 104. The display driver IC 104 generates an output signal SRGBW to control the image display panel 30. Furthermore, the display driver IC 104 generates a light source control signal SBL and transmits it to the LED driver IC 105 via the bus 108.

If the processing operation of the signal processing unit 20 is realized by the CPU 101, then an output signal SRGBW is inputted from the CPU 101 to the display driver IC 104. A light source control signal SBL is also generated by the CPU 101 and is transmitted to the LED driver IC 105 via the bus 108.

Figure 8:
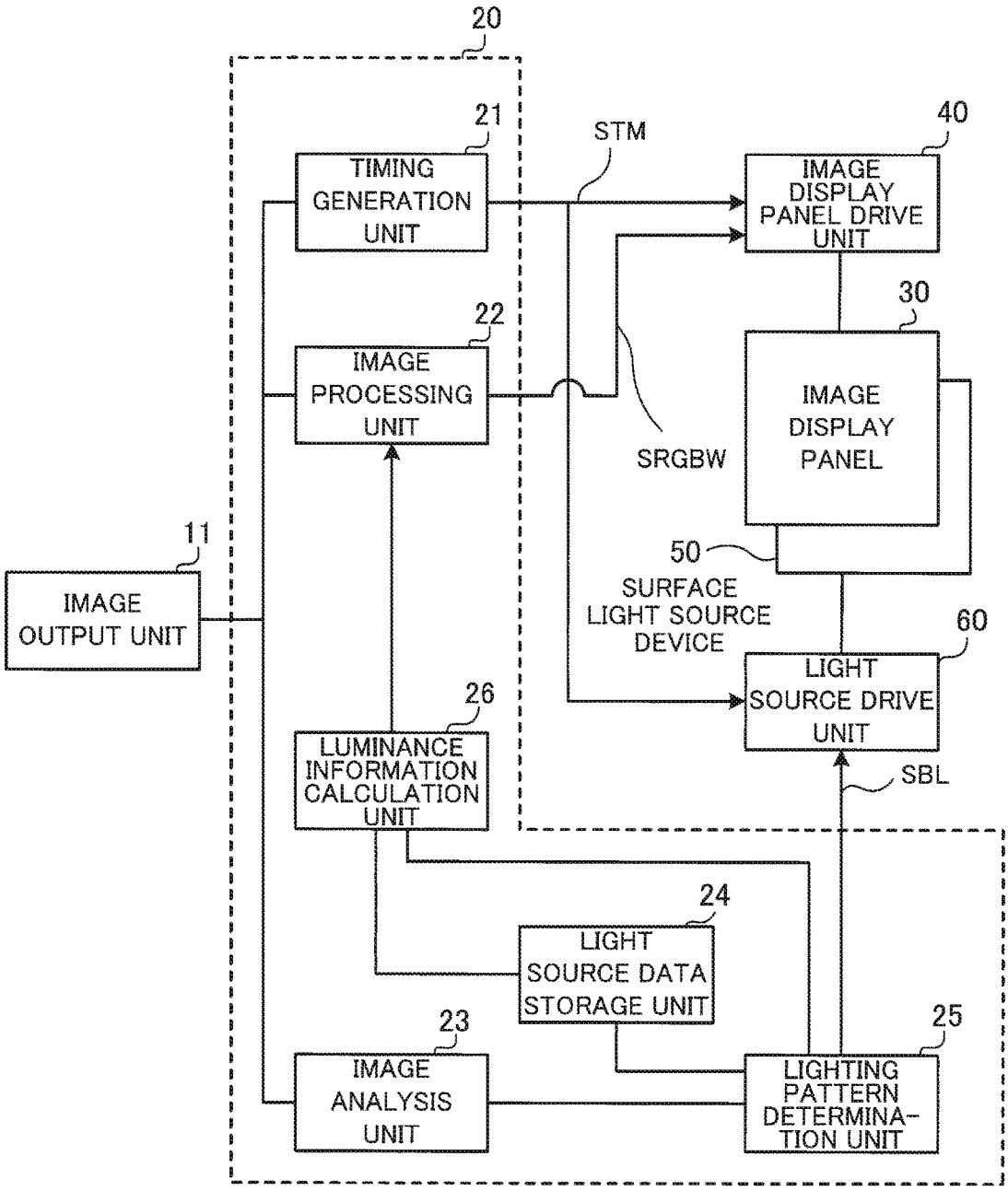
FIG. 8 is a functional block diagram of a signal processing unit in the second embodiment.

The functions of the signal processing unit 20 will now be described. FIG. 8 is a functional block diagram of the signal processing unit in the second embodiment.

The signal processing unit 20 includes a timing generation unit 21, an image processing unit 22, an image analysis unit 23, a light source data storage unit 24, a lighting pattern determination unit 25, and a luminance information calculation unit 26. An input signal SRGB is inputted from the image output unit 11 to the signal processing unit 20. The input signal SRGB includes color information on an image displayed at the position of each pixel 48. The timing generation unit 21 generates a synchronization signal STM for synchronizing the operation timing of the image display panel drive unit 40 with that of the light source drive unit 60 every image display frame. The timing generation unit 21 outputs the generated synchronization signal STM to the image display panel drive unit 40 and the light source drive unit 60.

The image processing unit 22 generates an output signal SRGBW on the basis of an input signal SRGB and luminance information for each pixel on the surface light source device 50 inputted from the luminance information calculation unit 26.

On the basis of an input signal SRGB, the image analysis unit 23 calculates a required luminance value of the surface light source device 50 needed for each of the blocks obtained by dividing a display surface of the image display panel 30. Each pixel 48 includes the fourth subpixel 49W, so its luminance can be adjusted. An index for adjusting the luminance of each pixel 48 is determined according to the input signal SRGB. With division drive control of the surface light source device 50, the luminance of each pixel 48 is adjusted and the luminance of the surface light source device 50 is reduced according to an increase in the luminance of each pixel 48. That is to say, there is a correspondence between the index for adjusting the luminance of each pixel 48 and an index for adjusting the luminance of the surface light source device 50. The image analysis unit 23 analyzes the input signal SRGB corresponding to each block, calculates a block correspondence index for adjusting the luminance of the surface light source device 50 for each block, and determines a required luminance value for each block. For example, the image analysis unit 23 calculates a block correspondence index on the basis of at least one of saturation and a value of the input signal SRGB corresponding to each block.

The light source data storage unit 24 stores luminance distribution information on the light sources 56. As illustrated in FIGS. 5 and 6, the light sources 56 differ in luminance distribution. Accordingly, the light source data storage unit 24 stores as luminance distribution information a luminance value on the entire surface of the surface light source device 50 detected at the time of lighting each light source 56 at a determined lighting amount. Luminance distribution information will be described by the use of FIGS. 9 and 10.

Figure 9:
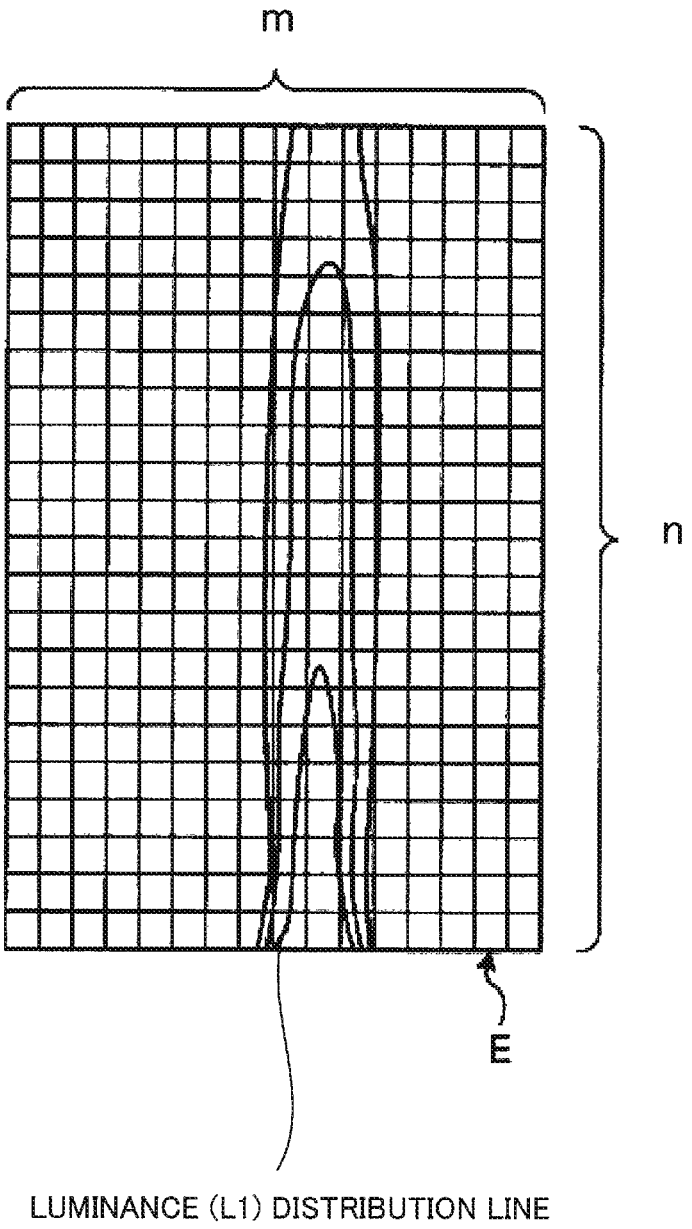
FIG. 9 is a schematic view for describing luminance distribution information.

FIG. 9 is a schematic view for describing luminance distribution information. As illustrated in FIG. 9, luminance distribution information indicates a luminance value of the surface light source device 50 detected for each of the (m×n) areas (m is any integer which satisfies $1 \leq m \leq P$ and n is any integer which satisfies $1 \leq n \leq Q$) obtained by dividing the display surface of the image display panel 30 (or an output surface of the surface light source device 50). The number of areas obtained by division is set to any number, but it does not exceed the number of pixels. If each area obtained by division corresponds to one pixel, then the luminance value for each pixel is stored as luminance distribution information. If each area obtained by division corresponds to more than one pixel, then a pixel at a determined position in each area is considered as a representative pixel and the luminance value of the surface light source device 50 for the representative pixel is stored. In the example of FIG. 9, the luminance value L1 is set as a luminance value for a representative pixel in an area inside a luminance (L1) distribution line indicative of the luminance value L1. The light source data storage unit stores luminance distribution information in which luminance values for (m×n) areas are set for each light source 56 in a tabular form. In the following description the luminance distribution information in a tabular form for each light source will be referred to as a light-source-specific LUT (LookUp Table). Light-source-specific lookup tables are information specific to the display device 10, so they are created in advance and are stored in the light source data storage unit 24.

Figure 10:
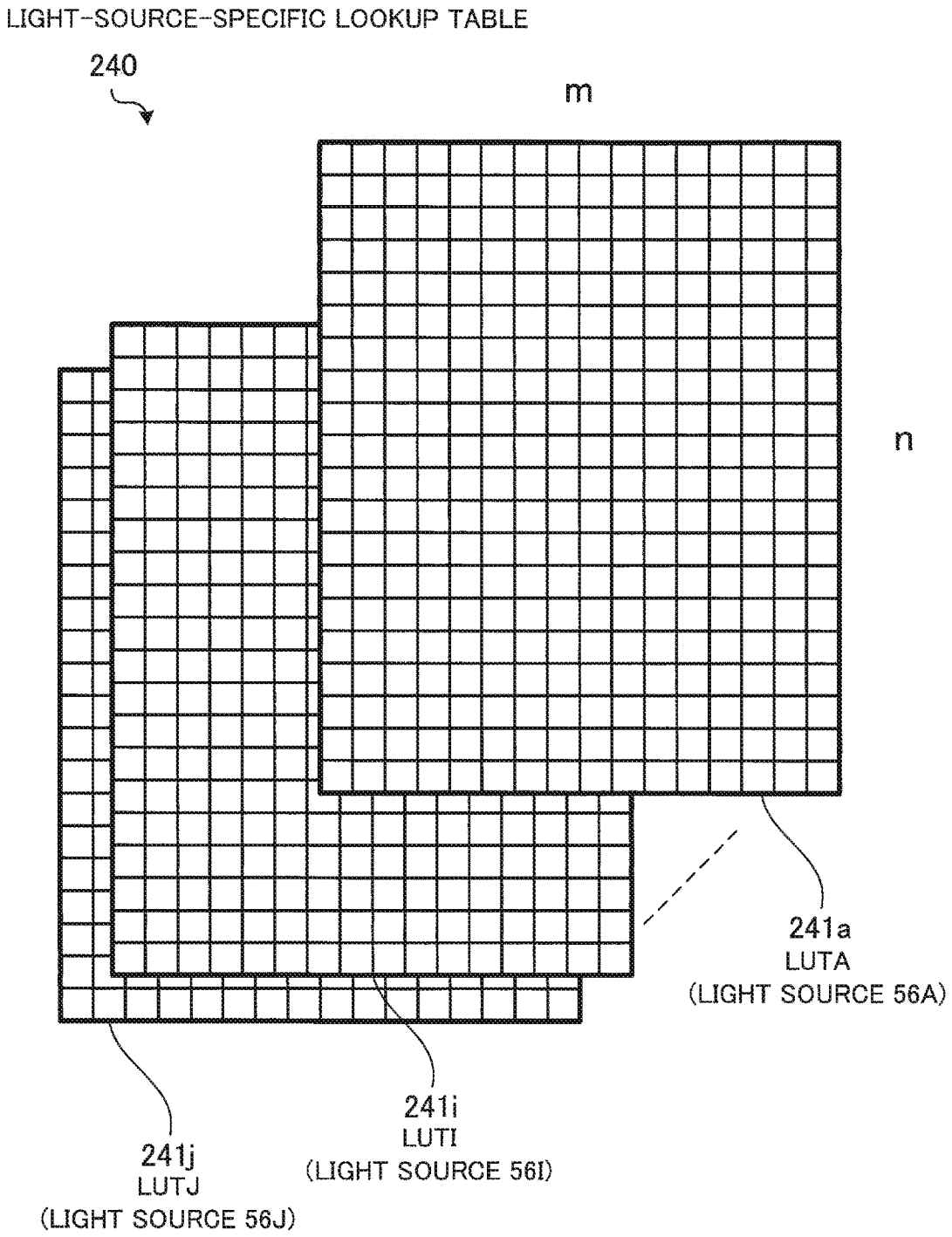
FIG. 10 illustrates lookup tables by light sources in the second embodiment.

FIG. 10 illustrates light-source-specific lookup tables in the second embodiment. A light-source-specific lookup table 240 is prepared for each of the light sources 56A, 56B, 56C, 56D, 56E, 56F, 56G, 56H, 56I, and 56J. Luminance values detected for (m×n) areas at the time of lighting only the light source 56A are recorded in a tabular form in a LUTA 241*a*. Similarly, LUTs are prepared in the same way for the light sources 56B, 56C, 56D, 56E, 56F, 56G, 56H, 56I, and 56J. FIG. 10 illustrates a LUTI 241*i* for the light source 56I and a LUTJ 241*j* for the light source 56J. If a luminance value for a representative pixel which represents a determined area is used, the size of the light-source-specific lookup table 240 becomes smaller and the storage capacity of the light source data storage unit 24 is reduced. When a luminance value for each pixel is needed, it is calculated by interpolation calculation. The light-source-specific lookup table 240 is information obtained by lighting one light source 56 at a time. However, a light-source-specific lookup table obtained by simultaneously lighting a combination of the light sources 56A and 56B, a combination of the light sources 56C and 56D, or the like may be created and stored. This reduces the amount of work for creating light-source-specific lookup tables and the storage capacity of the light source data storage unit 24.

Furthermore, luminance values are set in a corrected state in the light-source-specific lookup tables 240 so as to accommodate correction of luminance irregularity. By using the light source-specific lookup tables 240, correction of luminance irregularity and lighting pattern determination are performed at the same time.

Description will return to FIG. 8.

The lighting pattern determination unit 25 determines a lighting pattern of the sidelight light source 52 on the basis of a required luminance value for each block calculated by the image analysis unit 23 and the light-source-specific lookup tables 240 stored in the light source data storage unit 24. The lighting pattern determination unit 25 may find a lighting pattern of the sidelight light source 52 by calculation. Furthermore, the lighting pattern determination unit 25 may set a tentative lighting pattern of the sidelight light source 52, calculate tentative luminance distribution information for the tentative lighting pattern by the use of the light-source-specific lookup tables 240, compare the required luminance value with the tentative luminance distribution information to make a correction, and determine a lighting pattern. The lighting pattern determination unit 25 generates a light source control signal SBL on the basis of the lighting pattern and outputs it to the light source drive unit 60.

The luminance information calculation unit 26 uses a lighting pattern and the light source-specific lookup tables 240 stored in the light source data storage unit 24 for calculating luminance information for each pixel on the surface light source device 50 at the time of lighting the sidelight light source 52 according to the lighting pattern. First the luminance information calculation unit 26 uses the light-source-specific lookup tables 240 for calculating actual luminance distribution information for each light source at the time of actually lighting the sidelight light source 52 according to the lighting pattern. If pixel-by-pixel information is not obtained from the light-source-specific lookup tables 240, then the luminance information calculation unit 26 performs interpolation calculation for calculating actual luminance distribution information for each light source. The luminance information calculation unit 26 then combines the actual luminance distribution information for the light sources for finding actual luminance distribution information on the sidelight light source 52, and transmits it to the image processing unit 22. A Luminance value of the surface light source device 50 is set for each pixel in the calculated actual luminance distribution information on the sidelight light source 52.

A process performed by the image processing unit 22 which acquires actual luminance distribution information from the luminance information calculation unit 26 will be described. The image processing unit 22 obtains a luminance value of the surface light source device 50 for each pixel from the actual luminance distribution information. As stated above, the luminance of the surface light source device 50 is calculated by the index for reducing the luminance. In addition, when there is a determined correspondence between the index for reducing the luminance and the index for increasing the luminance of each pixel 48, display is performed with proper luminance. The image processing unit 22 calculates, from the luminance value of the surface light source device 50 for each pixel, a first pixel correspondence index for reducing the luminance of the surface light source device 50. Furthermore, the image processing unit calculates a second pixel correspondence index for increasing the luminance of each pixel 48 which corresponds to the first pixel correspondence index, and generates an output signal SRGBW by the use of the second pixel correspondence index.

A case where the expansion coefficient $\alpha$ is used as the index for increasing the luminance of each pixel 48 or the index for reducing the luminance of the surface light source device 50 will now be described.

Each pixel 48 of the display device 10 includes the fourth subpixel 49W which outputs the fourth color (white). This extends the dynamic range of a value in reproduction HSV color space which can be reproduced by the display device 10. "H" represents hue, "S" represents saturation, and "V" represents a value.

Figure 11:
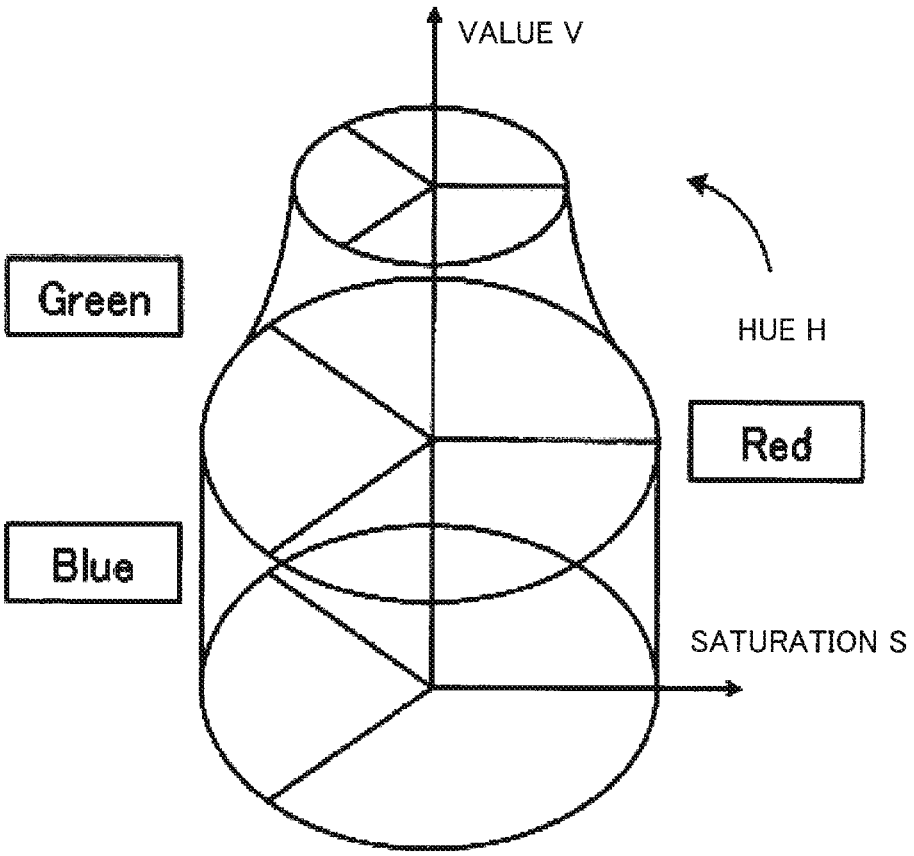
FIG. 11 is a schematic view of reproduction HSV color space which can be reproduced by the display device according to the second embodiment.

FIG. 11 is a schematic view of reproduction HSV color space which can be reproduced by the display device according to the second embodiment. As illustrated in FIG. 11, the reproduction HSV color space to which the fourth color has been added has a shape obtained by putting an approximately trapezoid solid in which, as the saturation S increases, the maximum value of the value V becomes smaller on cylindrical HSV color space which the first subpixel 49R, the second subpixel 49G, and the third subpixel 49B display. The signal processing unit 20 stores the maximum value Vmax(S) of a value expressed with the saturation S in the reproduction HSV color space which has been extended by adding the fourth color as a variable. That is to say, the signal processing unit 20 stores the maximum value Vmax(S) of a value by the coordinates (values) of the saturation S and the hue H for the solid shape of the reproduction HSV color space illustrated in FIG. 11.

An input signal SRGB includes input signal values corresponding to the first, second, and third primary colors, so HSV color space of the input signal SRGB has a cylindrical shape, that is to say, has the same shape as a cylindrical portion of the reproduction HSV color space illustrated in FIG. 11 has. Accordingly, an output signal SRGBW is calculated as an expanded image signal obtained by expanding the input signal SRGB to make it fall within the reproduction HSV color space. The input signal SRGB is expanded by the use of the expansion coefficient $\alpha$ determined by comparing the value levels of subpixels of the input signal SRGB in the reproduction HSV color space. By expanding the level of an input image signal by the use of the expansion coefficient $\alpha$, an output signal value corresponding to the fourth subpixel 49W can be made large. This increases the luminance of an entire image. At this time the luminance of the surface light source device 50 is reduced to $1/\alpha$ according to an increase in the luminance of the entire image caused by the use of the expansion coefficient $\alpha$. By doing so, display is performed with exactly the same luminance as with the input signal SRGB.

The expansion of an input signal SRGB will now be described.

An output signal value $X1_{(p,\ q)}$ corresponding to the first subpixel 49R, an output signal value $X2_{(p,\ q)}$ corresponding to the second subpixel 49G, and an output signal value $X3_{(p,\ q)}$ corresponding to the third subpixel 49B for a (p, q)th pixel (or a combination of the first subpixel 49R, the second subpixel 49G, and the third subpixel 49B) are expressed as:

$$X1_{(p,q)}=\alpha\cdot x1_{(p,q)}-\chi\cdot X4_{(p,q)} \quad (1)$$

$$X2_{(p,q)}=\alpha\cdot x2_{(p,q)}-\chi\cdot X4_{(p,q)} \quad (2)$$

$$X3_{(p,q)}=\alpha\cdot x3_{(p,q)}-\chi\cdot X4_{(p,q)} \quad (3)$$

where $\alpha$ is an expansion coefficient and $\chi$ is a constant which depends on the display device 10. $\chi$ will be described later.

In addition, an output signal value $X4_{(p,\ q)}$ is calculated on the basis of the product of $Min_{(p,\ q)}$ and the expansion coefficient $\alpha$, where $Min_{(p,\ q)}$ is the minimum value of an input signal value $x1_{(p,\ q)}$ corresponding to the first subpixel 49R, an input signal value $x2_{(p,\ q)}$ corresponding to the second subpixel 49G, and an input signal value $x3_{(p,\ q)}$ corresponding to the third subpixel 49B. To be concrete, an output signal value $X4_{(p,\ q)}$ is found on the basis of $$X4_{(p,q)}=Min_{(p,q)}\cdot\alpha/\chi \quad (4)$$

In expression (4), the product of $Min_{(p, q)}$ and the expansion coefficient $\alpha$ is divided by $\chi$. However, another calculation method may be adopted. Furthermore, the expansion coefficient $\alpha$ is determined every image display frame.

These points will now be described.

On the basis of an input signal SRGB for the (p, q)th pixel including an input signal value $x1_{(p, q)}$ corresponding to the first subpixel 49R, an input signal value $x2_{(p, q)}$ corresponding to the second subpixel 49G, and an input signal value $x3_{(p, q)}$ corresponding to the third subpixel 49B, usually saturation $S_{(p, q)}$ and value $V(S)_{(p, q)}$ in the cylindrical HSV color space are found from $$S_{(p,q)}=(Max_{(p,q)}-Min_{(p,q)})/Max_{(p,q)} \quad (5)$$

$$V(S)_{(p,q)}=Max_{(p,q)} \quad (6)$$

where $Max_{(p, q)}$ is the maximum value of the input signal value $x1_{(p, q)}$ for the first subpixel 49R, the input signal value $x2_{(p, q)}$ for the second subpixel 49G, and the input signal value $x3_{(p, q)}$ for the third subpixel 49B, $Min_{(p, q)}$, as stated above, is the minimum value of the input signal value $x1_{(p, q)}$ for the first subpixel 49R, the input signal value $x2_{(p, q)}$ for the second subpixel 49G, and the input signal value $x3_{(p, q)}$ for the third subpixel 49B, the saturation S has a value in the range of 0 to 1, and the value V(S) has a value in the range of 0 to $(2^n-1)$, where n is a display gradation bit number.

A color filter is not disposed between the fourth subpixel 49W which displays white and an observer of an image. If a light source lights the first subpixel 49R which displays the first primary color, the second subpixel 49G which displays the second primary color, the third subpixel 49B which displays the third primary color, and the fourth subpixel 49W which displays the fourth color at the same light source lighting amount, then the fourth subpixel 49W is brighter than the first subpixel 49R, the second subpixel 49G, and the third subpixel 49B. It is assumed that when a signal value corresponding to the maximum value of output signal values corresponding to the first subpixels 49R is inputted to a first subpixel 49R, a signal value corresponding to the maximum value of output signal values corresponding to the second subpixels 49G is inputted to a second subpixel 49G, and a signal value corresponding to the maximum value of output signal values corresponding to the third subpixels 49B is inputted to a third subpixel 49B, the luminance of a set of a first subpixel 49R, a second subpixel 49G, and a third subpixel 49B included in each pixel 48 or the luminance of a set of first subpixels 49R, second subpixels 49G, and third subpixels 49B included in a group of pixels 48 is $BN_{1-3}$. Furthermore, it is assumed that when a signal value corresponding to the maximum value of output signal values corresponding to a fourth subpixel 49W included in each pixel 48 or fourth subpixels 49W included in a group of pixels 48 is inputted to a fourth subpixel 49W, the luminance of the fourth subpixel 49W is $BN_4$. That is to say, white which has the maximum luminance is displayed by a set of a first subpixel 49R, a second subpixel 49G, and a third subpixel 49B and the luminance of white is $BN_{1-3}$. As a result, the constant $\chi$ which depends on the display device 10 is expressed as $$\chi=BN_4/BN_{1-3}$$

By the way, if the output signal value $X4_{(p, q)}$ is given by the above expression (4), the maximum value Vmax(S) of a value is expressed, with the saturation S in the reproduction HSV color space as a variable, as:

If $S \leq S_0$, then $$Vmax(S)=(\chi+1)\cdot(2^n-1) \quad (7)$$

If $S_0<S\leq 1$, then $$Vmax(S)=(2^n-1)\cdot(1/S) \quad (8)$$

where $S_0=1/(\chi+1)$.

The maximum value Vmax(S) of a value which is expressed with the saturation S in the reproduction HSV color space that has been extended by adding the fourth color as a variable and which is obtained in this way is stored in, for example, the signal processing unit 20 as a type of lookup table. Alternatively, the maximum value Vmax(S) of a value expressed with the saturation S in the reproduction HSV color space as a variable is found every time by the signal processing unit 20.

The expansion coefficient $\alpha$ is used for expanding the value V(S) in the HSV color space into the reproduction HSV color space and is expressed as $$\alpha(S)=Vmax(S)/V(S) \quad (9)$$

In expansion calculation, the expansion coefficient $\alpha$ is determined on the basis of, for example, $\alpha(S)$ found for plural pixels 48.

Signal processing performed by the signal processing unit 20 by the use of the expansion coefficient $\alpha$ will now be described. The following signal processing is performed so that the ratio among the luminance of the first primary color displayed by (first subpixel 49R+fourth subpixel 49W), the luminance of the second primary color displayed by (second subpixel 49G+fourth subpixel 49W), and the luminance of the third primary color displayed by (third subpixel 49B+fourth subpixel 49W) will be held, so that a color tone will be held (maintained), and so that a gradation-luminance characteristic ($\gamma$ characteristic) will be held (maintained). Furthermore, if all input signal values are 0 or small for a pixel 48 or a group of pixels 48, then the expansion coefficient $\alpha$ may be calculated with the pixel 48 or the group of pixels 48 excluded.

A process performed by the image analysis unit 23 will be described. On the basis of an input signal SRGB for plural pixels 48 included in a block, the image analysis unit 23 finds the saturation S and the value V(S) of the plural pixels 48. To be concrete, the image analysis unit 23 uses an input signal value $x1_{(p, q)}$, an input signal value $x2_{(p, q)}$, and an input signal value $x3_{(p, q)}$ for a (p, q)th pixel 48 and finds $S_{(p, q)}$ and $V(S)_{(p, q)}$ from expressions (5) and (6) respectively. The image analysis unit 23 performs this process on all pixels in the block. As a result, combinations of ($S_{(p, q)}$, $V(S)_{(p, q)}$) the number of which corresponds to the number of pixels 48 in the block are obtained. Next, the image analysis unit 23 finds the expansion coefficient $\alpha$ on the basis of at least one of $\alpha(S)$ values found for the pixels 48 in the block. For example, the image analysis unit 23 considers the smallest value of $\alpha(S)$ values found for the pixels 48 in the block as the expansion coefficient $\alpha$ for the block. The image analysis unit 23 calculates the expansion coefficient $\alpha$ for the block in this way.

The image analysis unit 23 repeats this procedure for each block and calculates the expansion coefficient $\alpha$ for each block. Luminance required for a block is calculated by the use of $1/\alpha$ which is the reciprocal of the expansion coefficient $\alpha$. $1/\alpha$ is an example of a block correspondence index.

FIG. 12 illustrates an example of a required luminance value for each block in the second embodiment. Information regarding a required luminance value for each of the 27 (=3×9) blocks obtained by dividing an emission surface of the surface light source device 50 is set in required luminance value information 270 illustrated in FIG. 12.

Information regarding a required luminance value may be, for example, the expansion coefficient α, 1/α, or a luminance value after conversion calculated for each block. As stated above, the required luminance values illustrated in FIG. 12 is an example. In addition, the number of blocks obtained by division is not limited to 27 and is arbitrarily selected.

A process performed by the lighting pattern determination unit 25 will now be described. The lighting pattern determination unit 25 determines a lighting pattern of the sidelight light source 52 on the basis of the required luminance value information 270 acquired from the image analysis unit 23 and the light-source-specific lookup tables 240 stored in the light source data storage unit 24.

First the lighting pattern determination unit 25 sets a tentative lighting pattern of the sidelight light source 52. The lighting pattern determination unit 25 then uses the light-source-specific lookup tables 240 for combining tentative luminance distribution information at the time of lighting the sidelight light source 52 according to the tentative lighting pattern. For example, the lighting pattern determination unit 25 uses the light-source-specific lookup table LUTA 241*a* regarding the light source 56A for calculating tentative luminance distribution information at the time of lighting the light source 56A at a lighting amount of the tentative lighting pattern. Similarly, the lighting pattern determination unit 25 calculates tentative luminance distribution information at the time of lighting each of the light sources 56B, 56C, 56D, 56E, 56F, 56G, 56H, 56I, and 56J at a lighting amount of the tentative lighting pattern. Thus calculated tentative luminance distribution information for the light sources is combined to obtain tentative luminance distribution information on the sidelight light source 52. The tentative luminance distribution information $T_{(i,j)}$ of the sidelight light source 52 is represented, for example, by $$T(i, j) = \sum_{k=0}^{n} T_{k(i,j)} \cdot a_k \tag{10}$$

where $T_k$ is a light-source-specific lookup table regarding each light source and $a_k$ is a lighting amount set for each light source 56. The lighting pattern determination unit 25 calculates the tentative luminance distribution information on the sidelight light source 52 in this way by referring to the light-source-specific lookup tables 240 in place of performing calculations by the use of expression (10), so the amount of calculation is reduced.

Next, the lighting pattern determination unit 25 compares the obtained tentative luminance distribution information on the sidelight light source 52 with a required luminance value for each block. If there is a difference between them, then the lighting pattern determination unit 25 corrects the tentative lighting pattern.

Figure 13:
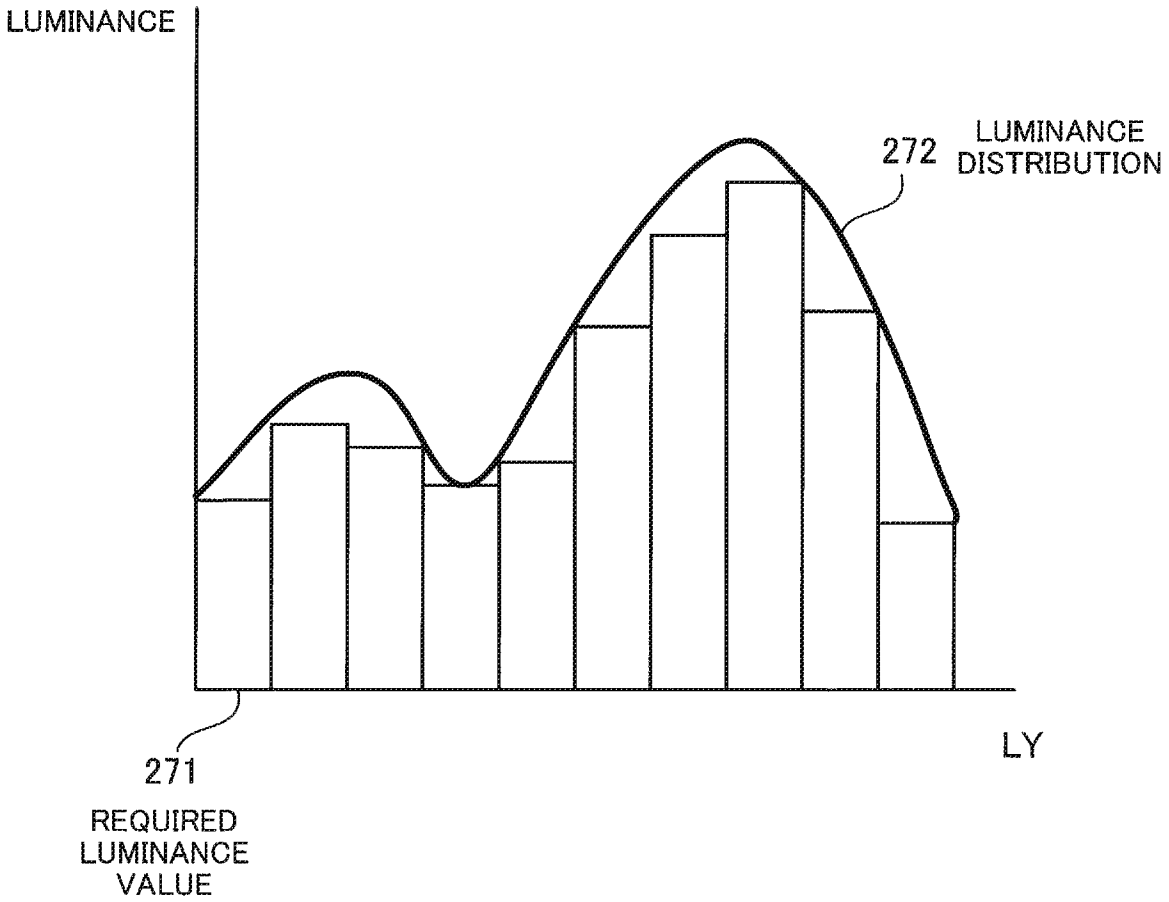
FIG. 13 illustrates the relationship between a required luminance value and luminance distribution in the second embodiment.

Correction of the tentative lighting pattern will be described. FIG. 13 illustrates the relationship between a required luminance value and luminance distribution in the second embodiment. FIG. 13 is a sectional view taken in the direction LY. The same applies to a sectional view taken in the direction LX.

As illustrated in FIG. 13, a required luminance value 271 is determined for each block, so luminance changes like steps in the direction LY. On the other hand, luminance distribution 272 continuously changes at the time of lighting the sidelight light source 52. The tentative lighting pattern is corrected so that the luminance distribution 272 at the time of lighting the sidelight light source 52 will not be lower than the required luminance value 271 in any area.

After the lighting pattern determination unit 25 corrects the tentative lighting pattern, the lighting pattern determination unit 25 uses a tentative lighting pattern after the correction for repeating the above procedure. By doing so, the lighting pattern determination unit 25 determines a lighting pattern which satisfies a required luminance value for each block.

Furthermore, a dimming process is performed on the lighting pattern which the lighting pattern determination unit 25 determines so as to satisfy a required luminance value for each block. In the dimming process, the obtained lighting pattern and a lighting pattern outputted the last time are compared. If there is a light source 56 whose luminance suddenly changes by an amount greater than a determined value, then a correction is made to control the amount of the change. The dimming process prevents the luminance of the surface light source device 50 from changing suddenly.

A lighting pattern is determined through the above procedure.

FIG. 14 illustrates an example of a lighting pattern in the second embodiment.

In a lighting pattern (light source lighting amount) 280 illustrated in FIG. 14, a lighting pattern of the sidelight light source 52 determined by the lighting pattern determination unit 25, that is to say, a lighting amount of each of the light sources 56A, 56B, 56C, 56D, 56E, 56F, 56G, 56H, 56I, and 56J is set.

The lighting pattern determination unit 25 outputs the determined lighting pattern (light source lighting amount) 280 to the light source drive unit 60 as a light source control signal SBL. The light source drive unit 60 controls the drive of each light source 56 on the basis of the determined lighting pattern (light source lighting amount) 280. The lighting pattern determination unit 25 also outputs the lighting pattern (light source lighting amount) 280 to the luminance information calculation unit 26. In the above description, a tentative lighting pattern is set and a correction is made repeatedly. However, if an optimum lighting pattern is obtained by performing a calculation once, then comparison between actual luminance distribution information based on the lighting pattern and a required luminance value and correction of the lighting pattern may be omitted.

A process performed by the luminance information calculation unit 26 will now be described. The luminance information calculation unit 26 generates luminance information for each pixel on the surface light source device 50 on the basis of the lighting pattern (light source lighting amount) 280 acquired from the lighting pattern determination unit 25 and the light-source-specific lookup tables 240 stored in the light source data storage unit 24. To be concrete, the luminance information calculation unit 26 uses the light-source-specific lookup tables 240 for calculating actual luminance distribution information for each light source at the time of lighting the sidelight light source 52 according to the determined lighting pattern 280. If the obtained actual luminance distribution information for each light source is not pixel-by-pixel information, then the luminance information calculation unit 26 calculates a luminance value for each pixel from luminance values for representative pixels. For example, the luminance information calculation unit 26 uses luminance information on representative pixels included in the light-source-specific lookup tables 240 for performing interpolation calculation based on linear interpolation or polynomial interpolation to generate actual luminance distribution information for each light source and for each pixel. The polynomial interpolation is cubic interpolation or the like.

Figure 15:
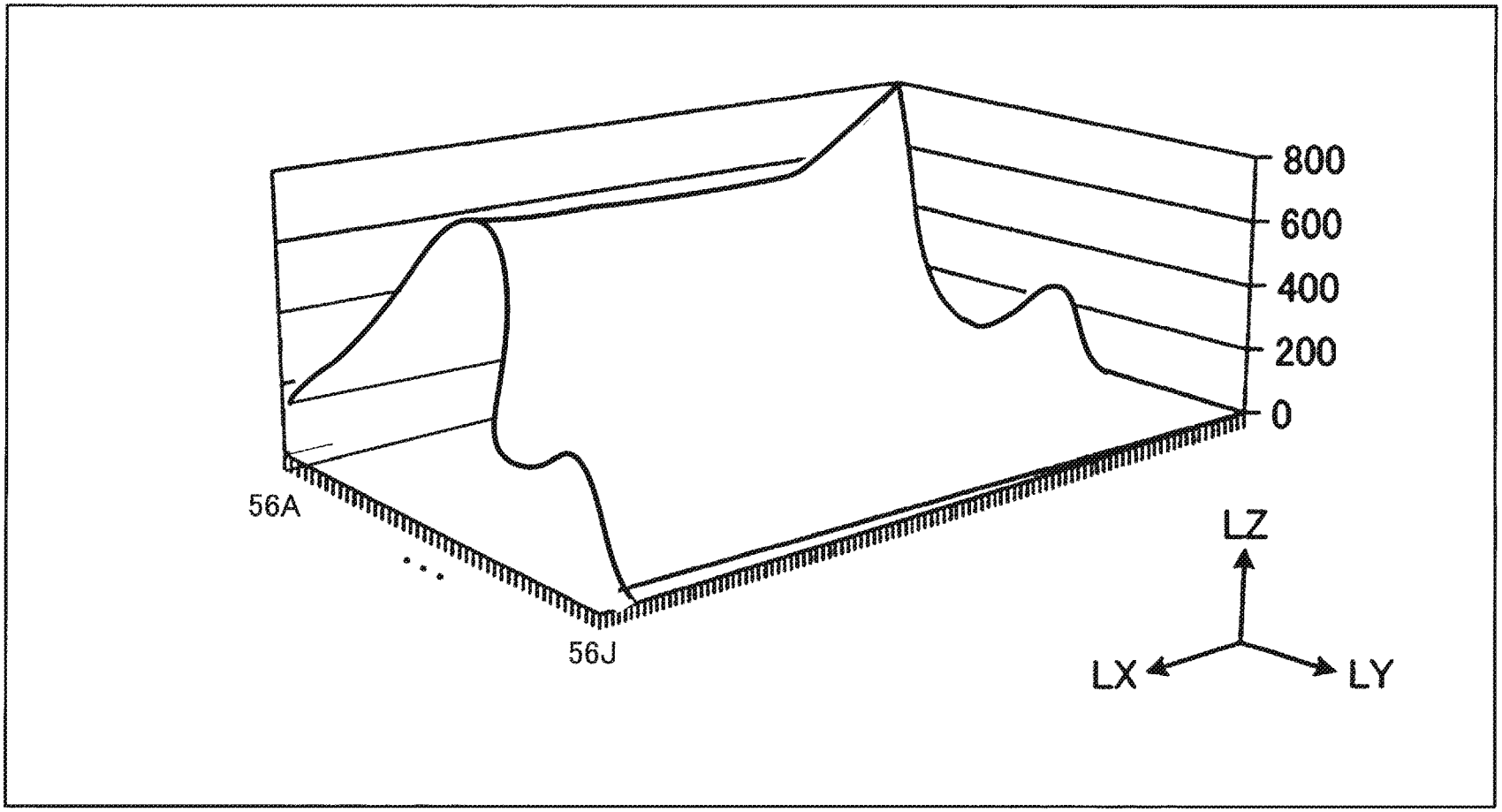
FIG. 15 illustrates an example of luminance distribution calculated by a luminance information calculation unit in the second embodiment.

The actual luminance distribution information for each light source and for each pixel calculated in this way is added to obtain actual luminance distribution information on the entire surface light source device 50. FIG. 15 illustrates an example of luminance distribution calculated by the luminance information calculation unit in the second embodiment. Luminance distribution illustrated in FIG. 15 is obtained by superimposing luminance distribution at the time of driving each light source 56.

The calculated actual luminance distribution information indicates a luminance value of the surface light source device 50 calculated for each pixel. The image processing unit 22 acquires luminance information on the surface light source device 50 for each pixel on the basis of the actual luminance distribution information.

A process performed by the image processing unit 22 will now be described. The image processing unit 22 calculates an output signal SRGBW for each pixel on the basis of the actual luminance distribution information calculated by the luminance information calculation unit 26. To be concrete, the expansion coefficient $\alpha$ for an input signal SRGB to a pixel (p, q) is the reciprocal of the index $1/\alpha$ for reducing corresponding luminance (p, q) of the surface light source device 50. The image processing unit 22 finds the expansion coefficient $\alpha$ for the pixel (p, q) on the basis of luminance information (p, q) on the surface light source device 50 for the pixel (p, q) included in the actual luminance distribution information. The image processing unit 22 calculates the expansion coefficient $\alpha$ for the pixel (p, q) in this way and obtains an output signal SRGBW by performing expansion calculation by the use of $\alpha$. The image processing unit 22 performs this expansion calculation by the use of, for example, expressions (1), (2), (3), and (4). The index $1/\alpha$ is an example of the first pixel correspondence index and the expansion coefficient $\alpha$ is an example of the second pixel correspondence index.

As has been described, the expansion coefficient $\alpha$ is used for exercising division drive control of the luminance of the surface light source device 50 and image display control of the image display panel 30. By doing so, the luminance of the surface light source device 50 is set to the smallest value that enables color reproduction by the display device 10 in the reproduction HSV color space. This reduces the power consumption of the display device 10. Furthermore, by controlling image display according to the luminance for each pixel of the surface light source device 50, image quality is maintained and contrast is improved.

A display control process performed by the display device 10 will now be described by the use of FIGS. 16 through 20.

Figure 16:
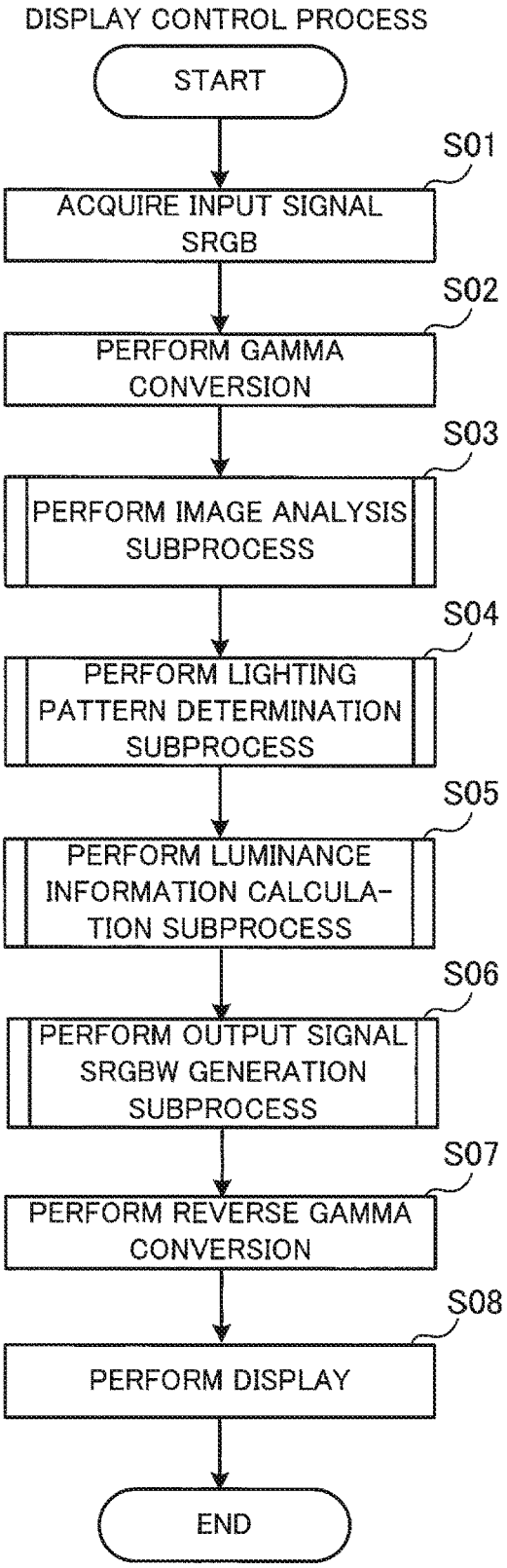
FIG. 16 is a flow chart of a display control process performed by the display device according to the second embodiment.

FIG. 16 is a flow chart of a display control process performed by the display device according to the second embodiment. The display device 10 starts a display control process every image display frame. An input signal SRGB is inputted via the image output unit 11 to the signal processing unit 20.

(Step S01) The signal processing unit 20 acquires the input signal SRGB.

(Step S02) The signal processing unit 20 gamma-converts the input signal SRGB to linearize it.

(Step S03) The image analysis unit 23 acquires the linearized input signal SRGB and performs an image analysis subprocess. In the image analysis subprocess, the image analysis unit 23 calculates a required luminance value of the surface light source device 50 on the basis of the input signal SRGB for each of the blocks obtained by dividing the display surface of the image display panel 30. The details of the image analysis subprocess will be described later.

(Step S04) The lighting pattern determination unit 25 acquires a required luminance value for each block, refers to the light-source-specific lookup tables 240 stored in the light source data storage unit 24, and determines a lighting pattern of the sidelight light source 52 which satisfies the required luminance value. In addition, the lighting pattern determination unit 25 outputs to the light source drive unit 60 a light source control signal SBL corresponding to the lighting pattern. The details of the lighting pattern determination subprocess will be described later by the use of FIG. 18.

(Step S05) On the basis of the light-source-specific lookup tables 240, the luminance information calculation unit 26 generates actual luminance distribution information at the time of driving the sidelight light source 52 according to the determined lighting pattern. The generated actual luminance distribution information includes pixel-by-pixel luminance information on the surface light source device 50. The details of the luminance information calculation subprocess will be described later.

(Step S06) The image processing unit 22 generates from the input signal SRGB an output signal SRGBW for each pixel in which corresponding luminance information on the surface light source device 50 is reflected. The details of the output signal SRGBW generation subprocess will be described later.

(Step S07) The image processing unit 22 performs reverse gamma conversion on the output signals SRGBW and outputs them to the image display panel drive unit 40.

(Step S08) Display is performed. In synchronization with a synchronization signal STM generated by the timing generation unit 21, the image display panel drive unit 40 outputs the output signals SRGBW to the image display panel 30 and the light source drive unit 60 drives the light sources 56 of the surface light source device 50.

By performing the above process, an image of the input signal SRGB is reproduced on the image display panel 30. The luminance of the surface light source device 50 which lights the image display panel 30 is controlled for each block according to the input signal SRGB. This reduces the luminance of the surface light source device 50 and reduces power consumption. Furthermore, luminance information on the surface light source device 50 calculated for each pixel is reflected in each output signal SRGBW. This maintains image quality and improves contrast.

Figure 17:
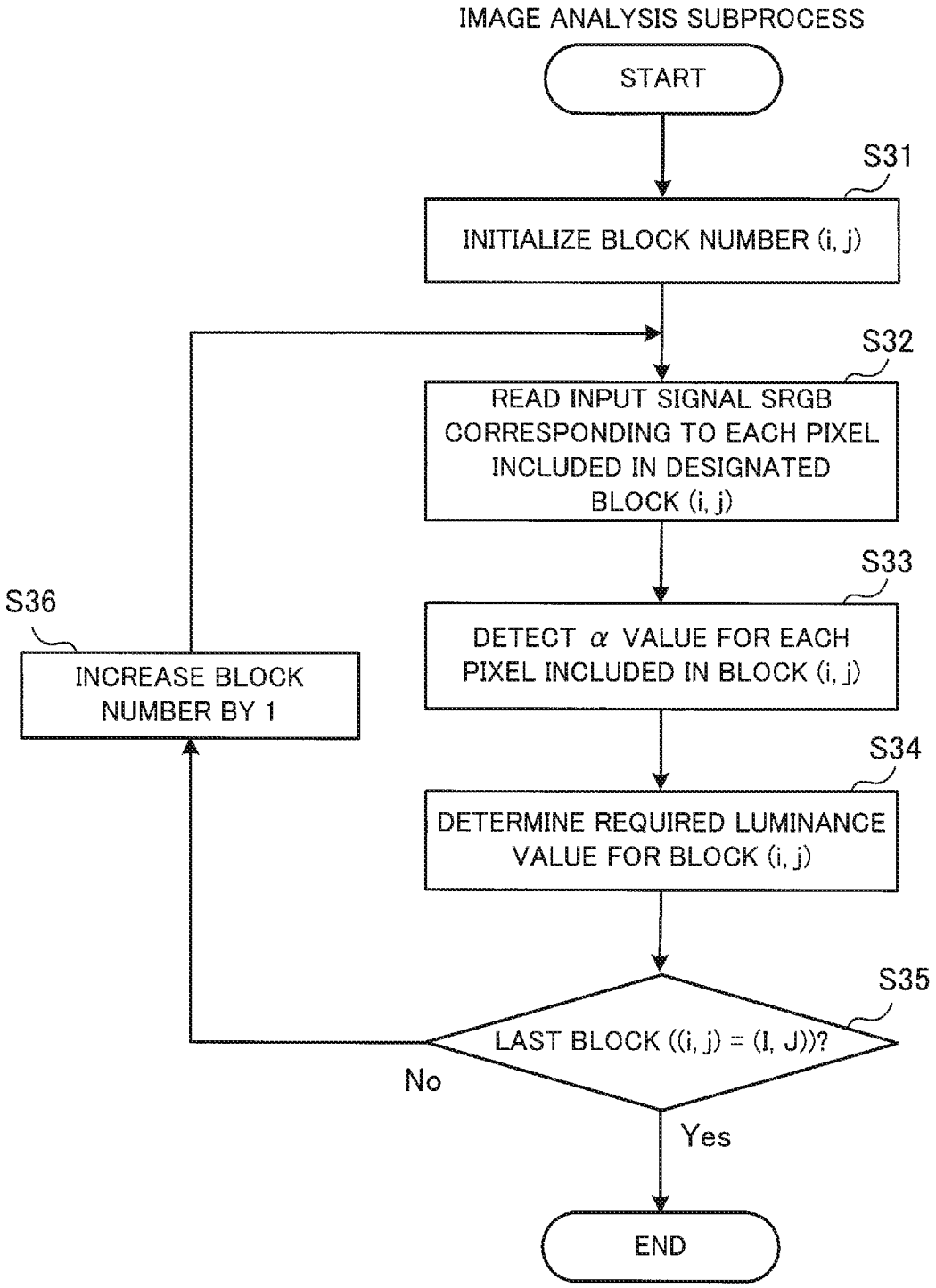
FIG. 17 is a flow chart of an image analysis subprocess in the second embodiment.

The image analysis subprocess will now be described by the use of FIG. 17. FIG. 17 is a flow chart of the image analysis subprocess in the second embodiment. The image analysis unit 23 acquires the input signal SRGB and starts the subprocess. The emission surface of the surface light source device 50 is divided into (I×J) blocks.

(Step S31) The image analysis unit 23 initializes a block number (i, j) by which a block to be processed is designated (sets a block number (i, j) to (1, 1)).

(Step S32) The image analysis unit 23 reads an input signal SRGB corresponding to each pixel included in a designated block (i, j).

(Step S33) The image analysis unit 23 detects an a value for each pixel. To be concrete, the image analysis unit 23 finds saturation $S_{(p,\ q)}$ and value $V(S)_{(p,\ q)}$ in the cylindrical HSV color space from an input signal SRGB corresponding to a target pixel by the use of expressions (5) and (6). The image analysis unit 23 finds an $\alpha$ value for the pixel from the saturation $S_{(p,\ q)}$ and the value $V(S)_{(p,\ q)}$ obtained in this way by the use of expression (9). The image analysis unit 23 repeats the same procedure to find α values for all pixels included in the block (i, j).

(Step S34) The image analysis unit 23 determines a required luminance value for the block (i, j) on the basis of at least one of the α values for all the pixels. For example, the image analysis unit 23 selects the smallest α value from among the α values for all the pixels included in the block (i, j), and considers the reciprocal 1/α of the smallest α value as a required luminance value for the block (i, j).

(Step S35) The image analysis unit 23 compares the block number (i, j) with the last block number (I, J) and determines whether or not the block (i, j) is the last block. If (i, j)=(I, J), then the image analysis unit 23 determines that the block (i, j) is the last block. In this case, the image analysis unit 23 has calculated required luminance values for all the blocks. Accordingly, the image analysis unit 23 ends the image analysis step. If the block (i, j) is not the last block, then the image analysis unit 23 proceeds to step S36.

(Step S36) The image analysis unit 23 increases the block number (i, j) by 1 and returns to step S32.

Luminance required values for the (I×J) blocks are calculated through the above procedure. By calculating a required luminance value in this way on the basis of an input signal SRGB expanded into the reproduction HSV color space, the required luminance value corresponds to an image whose luminance is increased by the fourth subpixel which displays the fourth color. Therefore, the luminance of the surface light source device 50 is low and power consumption is low, compared with a case where a required luminance value is simply found on the basis of an input signal SRGB. Furthermore, a required luminance value is determined for each block, so power consumption is reduced efficiently compared with a case where required luminance values are determined for the entire display surface.

Figure 18:
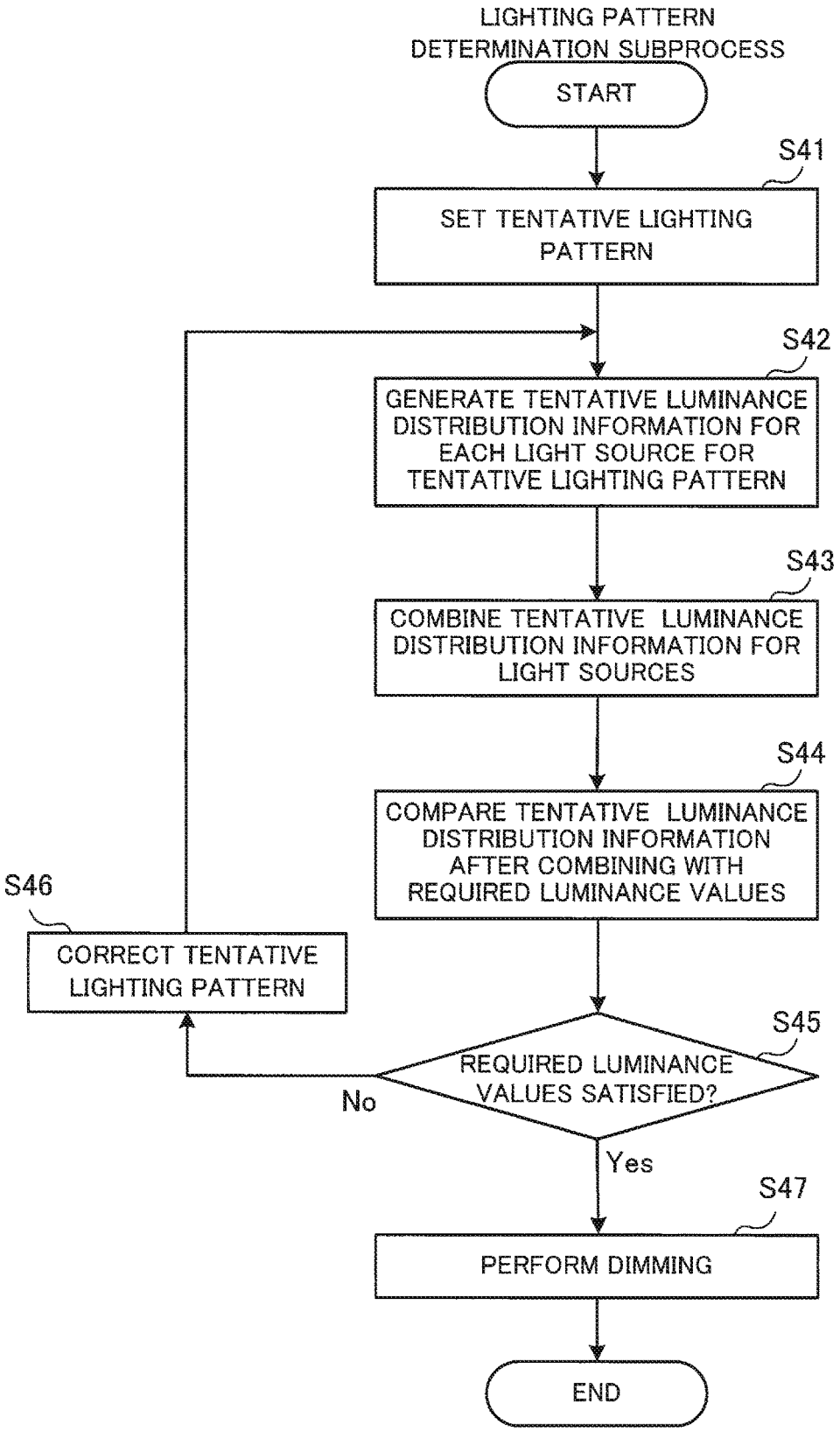
FIG. 18 is a flow chart of a lighting pattern determination subprocess in the second embodiment.

The lighting pattern determination subprocess will now be described by the use of FIG. 18. FIG. 18 is a flow chart of the lighting pattern determination subprocess in the second embodiment. After a required luminance value is determined for each block, the lighting pattern determination subprocess is started.

(Step S41) The lighting pattern determination unit 25 sets a tentative lighting pattern which determines a lighting amount of each light source 56 of the sidelight light source 52.

(Step S42) The lighting pattern determination unit 25 generates tentative luminance distribution information (luminance distribution information obtained while tentatively driving each light source 56) on each light source 56 at the time of lighting the sidelight light source 52 according to the set tentative lighting pattern. The lighting pattern determination unit 25 calculates tentative luminance distribution information on each light source 56 by referring to a corresponding light-source-specific lookup table 240 and converting luminance information at the time of lighting each light source 56 at a determined lighting amount, which is set in the light-source-specific lookup table 240, to luminance information at the time of lighting each light source 56 at a lighting amount of the tentative lighting pattern.

(Step S43) The lighting pattern determination unit 25 combines the tentative luminance distribution information obtained for each light source in step S42 to obtain tentative luminance distribution information on the surface light source device 50.

(Step S44) The lighting pattern determination unit 25 compares the tentative luminance distribution information on the surface light source device 50 for the tentative lighting pattern obtained in step S43 with required luminance values. For example, the lighting pattern determination unit 25 compares each piece of luminance information included in the tentative luminance distribution information with a required luminance value for a corresponding block, and detects whether or not the difference between them is in a determined range.

(Step S45) If the tentative luminance distribution information on the surface light source device 50 for the tentative lighting pattern satisfies the required luminance values as a result of the comparison in step S44, then the lighting pattern determination unit 25 proceeds to step S47. If the tentative luminance distribution information on the surface light source device 50 for the tentative lighting pattern does not satisfy the required luminance values, then the lighting pattern determination unit 25 proceeds to step S46.

(Step S46) If the tentative luminance distribution information on the surface light source device 50 for the tentative lighting pattern does not satisfy the required luminance values, then the lighting pattern determination unit 25 corrects the tentative lighting pattern according to the difference between them. The lighting pattern determination unit 25 repeats the subprocess from step S42 for a tentative lighting pattern after the correction.

(Step S47) If the tentative luminance distribution information on the surface light source device 50 for the tentative lighting pattern satisfies the required luminance values, then the lighting pattern determination unit 25 also performs dimming to determine a lighting pattern. In the dimming, the lighting pattern determination unit 25 refers to the luminance of each light source 56 in the previous image display frame and corrects a lighting amount of each light source 56 so that a sudden change in luminance will not take place.

As has been described, a tentative lighting pattern is set, tentative luminance distribution information is calculated for the tentative lighting pattern, the tentative luminance distribution information is compared with required luminance values, and the tentative lighting pattern is corrected. This operation is repeated. That is to say, by performing simple calculations, an optimum lighting pattern of the sidelight light source 52 is set. Furthermore, tentative luminance distribution information is calculated by referring to the light-source-specific lookup tables 240 in place of performing calculations by the use of expression (10), so the amount of calculation is reduced.

Figure 19:
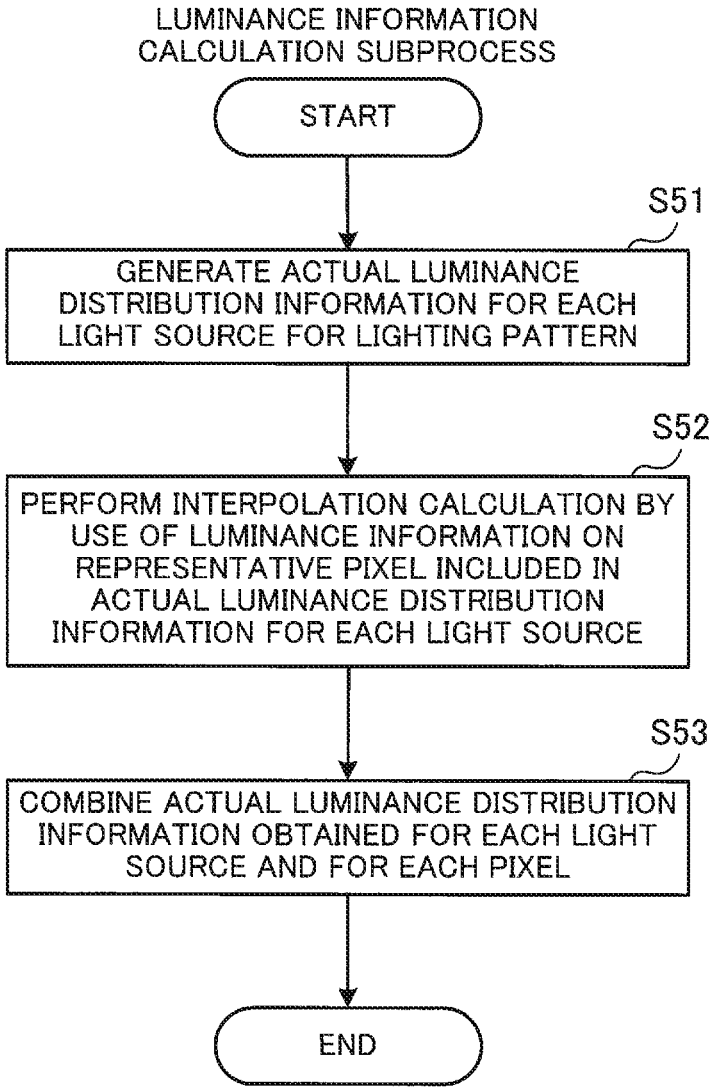
FIG. 19 is a flow chart of a luminance information calculation subprocess in the second embodiment.

The luminance information calculation subprocess will now be described by the use of FIG. 19. FIG. 19 is a flow chart of the luminance information calculation subprocess in the second embodiment. After a lighting pattern of the sidelight light source 52 is determined, the luminance information calculation subprocess is started.

(Step S51) The luminance information calculation unit 26 generates actual luminance distribution information (luminance distribution information obtained while actually driving each light source 56) for each light source at the time of driving the sidelight light source 52 according to the determined lighting pattern. The luminance information calculation unit 26 calculates actual luminance distribution information for each light source by referring to a corresponding light-source-specific lookup table 240 and converting luminance information set in the light-source-specific lookup table 240 to luminance information at the time of lighting a light source 56 at a lighting amount of the lighting pattern. The luminance information calculation unit 26 obtains in this way actual luminance distribution information for each light source at the time of driving the sidelight light source 52 according to the lighting pattern. The actual luminance distribution information for each light source obtained consists of luminance information on a representative pixel in each of the (m×n) areas obtained by dividing the display surface of the image display panel 30.

(Step S52) The luminance information calculation unit 26 performs interpolation calculation by the use of luminance information on a representative pixel included in the actual luminance distribution information for each light source found in step S51 to calculate actual luminance distribution information for each light source and for each pixel.

(Step S53) The luminance information calculation unit 26 combines the actual luminance distribution information obtained for each light source and for each pixel in step S52 to find actual luminance distribution information on the entire surface light source device 50.

The actual luminance distribution information including luminance information for each pixel on the surface light source device 50 is obtained in this way.

Figure 20:
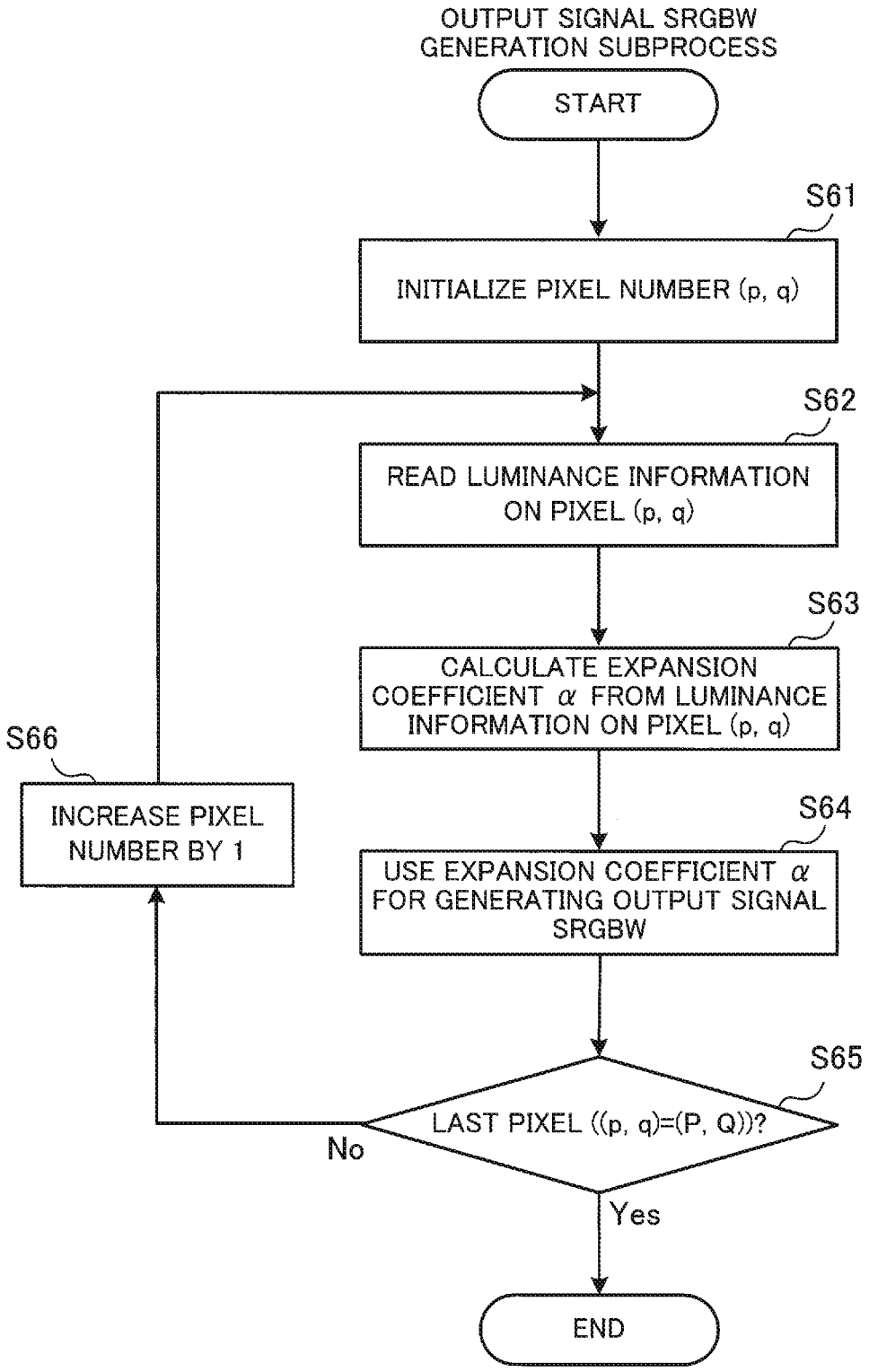
FIG. 20 is a flow chart of an output signal SRGBW generation subprocess in the second embodiment.

The output signal SRGBW generation subprocess will now be described by the use of FIG. 20. FIG. 20 is a flow chart of the output signal SRGBW generation subprocess in the second embodiment. After actual luminance distribution information including luminance information for each pixel on the surface light source device 50 is generated, the output signal SRGBW generation subprocess is started.

(Step S61) The image processing unit 22 initializes a pixel number (p, q) by which a pixel to be processed is designated (sets a pixel number (p, q) to (1, 1)).

(Step S62) The image processing unit 22 reads luminance information on a pixel (p, q) to be processed included in the actual luminance distribution information including the luminance information for each pixel on the surface light source device 50.

(Step S63) The image processing unit 22 calculates from the luminance information on the pixel (p, q) to be processed the expansion coefficient $\alpha$ for expanding an input signal SRGB. If the luminance of light which the surface light source device 50 directs at the pixel (p, q) to be processed is $1/\alpha$, then the luminance of an image is increased $\alpha$-fold in order to reproduce the input signal SRGB on the display surface. Accordingly, the image processing unit 22 calculates the reciprocal of the read luminance information on the pixel (p, q) to be processed as the expansion coefficient $\alpha$.

(Step S64) The image processing unit 22 uses the expansion coefficient $\alpha$ for expanding an input signal SRGB corresponding to the pixel (p, q) to be processed and generating an output signal SRGBW. To be concrete, the image processing unit 22 applies expressions (1), (2), (3), and (4) to an input signal value $x1_{(p,\ q)}$ for the first subpixel, an input signal value $x2_{(p,\ q)}$ for the second subpixel, and an input signal value $x3_{(p,\ q)}$ for the third subpixel included in the input signal SRGB to calculate an output signal value $X1_{(p,q)}$ for the first subpixel, an output signal value $X2_{(p,q)}$ for the second subpixel, an output signal value $X3_{(p,q)}$ for the third subpixel, and an output signal value $X4_{(p,q)}$ for the fourth subpixel.

(Step S65) The image processing unit 22 compares the pixel number (p, q) with the last pixel number (P, Q) to determine whether or not the pixel (p, q) is the last pixel. If (p, q) is (P, Q), then the image processing unit 22 determines that the pixel (p, q) is the last pixel. In this case, output signals SRGBW for all pixels have been generated, so the image processing unit 22 ends the output signal SRGBW generation subprocess. If the pixel (p, q) is not the last pixel, then the image processing unit 22 proceeds to step S66.

(Step S66) The image processing unit 22 increases the pixel number (p, q) by 1 and returns to step S62.

By performing the above subprocess, a proper output signal SRGBW corresponding to the luminance of the surface light source device 50 which lights each pixel is calculated. As a result, proper display is performed.

The above processing functions can be realized with a computer. In that case, a program in which the contents of the functions that the display device has are described is provided. By executing this program on the computer, the above processing functions are realized on the computer. This program may be recorded on a computer readable record medium. A computer readable record medium may be a magnetic recording device, an optical disk, a magneto-optical recording medium, a semiconductor memory, or the like. A magnetic recording device may be a HDD (Hard Disk Drive), a FD (Flexible Disk), a magnetic tape, or the like. An optical disk may be a DVD (Digital Versatile Disc), a DVD-RAM (Random Access Memory), a CD-ROM (Compact Disc Read Only Memory), a CD-R(Recordable)/RW (ReWritable), or the like. A magneto-optical recording medium may be a MO (Magneto-Optical disk) or the like.

To place the program on the market, portable record media, such as DVDs or CD-ROMs, on which it is recorded are sold. Alternatively, the program is stored in advance in a storage unit of a server computer and is transferred from the server computer to another computer via a network.

When a computer executes this program, it will store the program, which is recorded on a portable record medium or which is transferred from the server computer, in, for example, its storage unit. Then the computer reads the program from its storage unit and performs processes in compliance with the program. The computer may read the program directly from a portable record medium and perform processes in compliance with the program. Furthermore, each time the program is transferred from the server computer connected via a network, the computer may perform processes in order in compliance with the program it receives.

In addition, at least a part of the above processing functions may be realized by an electronic circuit such as a DSP (Digital Signal Processor), an ASIC (Application Specific Integrated Circuit), or a PLD (Programmable Logic Device).

According to one aspect, there is provided a display device that includes: an image display panel that includes a plurality of pixels, each of which includes a first subpixel which displays a first primary color, a second subpixel which displays a second primary color, a third subpixel which displays a third primary color, and a fourth subpixel which displays a fourth color; a lighting unit which emits light to the image display panel from the rear of the image display panel; and a control unit which calculates a required luminance value for each block obtained by dividing the display surface of the image display panel on the basis of an input image signal, which determines a light source lighting amount of the lighting unit on the basis of luminance distribution information on the lighting unit stored in advance so as to satisfy the required luminance value, which generates luminance information on each pixel on the basis of the luminance distribution information and the light source lighting amount, which generates an output image signal that drives the first subpixel, the second subpixel, the third subpixel, and the fourth subpixel on the basis of the luminance information and the input image signal, which controls the lighting unit by the light source lighting amount, and which controls the image display panel by the output image signal.

In the display device, the control unit calculates a block correspondence index corresponding to each block for adjusting luminance of the lighting unit on the basis of at least one of saturation and a value of the input image signal corresponding to pixels included in each block, and calculates the required luminance value on the basis of the block correspondence index.

Further, in the display device, the control unit calculates a first pixel correspondence index corresponding to each pixel for reducing luminance of the lighting unit on the basis of the luminance information, and generates the output image signal using a second pixel correspondence index corresponding to the first pixel correspondence index for increasing luminance of each pixel.

Still further, in the display device, the lighting unit includes a plurality of light sources which can operate independently of one another, and the control unit determines lighting patterns of the plurality of light sources so as to satisfy the required luminance value.

Still further, in the display device, the control unit sets tentative lighting patterns of the plurality of light sources, generates, on the basis of the tentative lighting patterns and the luminance distribution information, tentative luminance distribution information at the time of driving the lighting unit using the tentative lighting patterns, corrects the tentative lighting patterns by comparing the tentative luminance distribution information with the required luminance value, and determines the lighting patterns.

Still further, in the display device, the luminance distribution information is stored by light source units with one light source or a combination of two or more light sources, of the plurality of light sources, as one light source unit, and the control unit generates tentative luminance distribution information for each of the light source units on the basis of the tentative lighting patterns and the luminance distribution information for each of the light source units, and combines the tentative luminance distribution information for the light source units to generate the tentative luminance distribution information on the entire lighting unit.

Still further, in the display device, the luminance distribution information includes luminance information on a representative pixel which represents pixels in a determined area of the display surface, and the control unit generates luminance information for each pixel on the lighting unit by performing interpolation calculation by the use of the luminance information on the representative pixel.

Still further, in the display device, the fourth subpixel included in each pixel displays white, and an output value is determined on the basis of at least one of a value of the first primary color, a value of the second primary color, and a value of the third primary color corresponding to the input image signal, and luminance of each pixel of the image display panel is adjusted on the basis of the output value and output values for the first subpixel, the second subpixel, and the third subpixel determined according to the output value.

In addition, according to one aspect, there is provided a display device that includes: an image display panel including a plurality of pixels, each of which includes a first subpixel which displays red, a second subpixel which displays green, a third subpixel which displays blue, and a fourth subpixel which displays white; a lighting unit which emits light to the image display panel from a rear of the image display panel; and a control unit which calculates a required luminance value for each of blocks obtained by dividing a display surface of the image display panel on the basis of an input image signal corresponding to the red, the green, and the blue, which determines a light source lighting amount of the lighting unit on the basis of luminance distribution information on the lighting unit stored in advance so as to satisfy the required luminance value, which generates luminance information on each pixel on the basis of the luminance distribution information and the light source lighting amount, which generates an output image signal corresponding to the red, the green, the blue, and the white on the basis of the luminance information and the input image signal, which controls the lighting unit by the light source lighting amount, and which controls the image display panel by the output image signal.

In addition, there is provided a method for driving a display device that includes: an image display panel including a plurality of pixels each of which includes a first subpixel which displays a first primary color, a second subpixel which displays a second primary color, a third subpixel which displays a third primary color, and a fourth subpixel which displays a fourth color; and a lighting unit which emits light to the image display panel from a rear of the image display panel. The method includes: calculating a required luminance value for each of blocks obtained by dividing a display surface of the image display panel on the basis of an input image signal; determining a light source lighting amount of the lighting unit on the basis of luminance distribution information on the lighting unit stored in advance so as to satisfy the required luminance value; generating luminance information on each pixel on the basis of the luminance distribution information and the light source lighting amount; generating an output image signal which drives the first subpixel, the second subpixel, the third subpixel, and the fourth subpixel on the basis of the luminance information and the input image signal; controlling the lighting unit by the light source lighting amount; and controlling the image display panel by the output image signal.

All examples and conditional language provided herein are intended for the pedagogical purposes of aiding the reader in understanding the invention and the concepts contributed by the inventor to further the art, and are not to be construed as limitations to such specifically recited examples and conditions, nor does the organization of such examples in the specification relate to a showing of the superiority and inferiority of the invention. Although one or more embodiments of the present invention have been described in detail, it should be understood that various changes, substitutions, and alterations could be made hereto without departing from the spirit and scope of the invention.

What is claimed is:

1. A display device comprising:

an image display panel including a plurality of pixels, a backlight configured to emit light to the image display panel; and a controller, which calculates a required luminance value for each of blocks obtained by dividing a display surface of the image display panel on the basis of an input image signal, which determines a light source lighting amount of the backlight on the basis of luminance distribution information on the backlight stored in advance so as to satisfy the required luminance value, which generates luminance information on each pixel on the basis of the luminance distribution information and the light source lighting amount, which generates an output image signal that drives the pixels on the basis of the luminance information and the input image signal, which controls the backlight by the light source lighting amount, and which controls the image display panel by the output image signal.

2. The display device according to claim 1, wherein:

the controller calculates a block correspondence index corresponding to each block for adjusting luminance of the backlight on the basis of at least one of saturation or a value of the input image signal corresponding to pixels included in said each block, and calculates the required luminance value on the basis of the block correspondence index.

3. The display device according to claim 1, wherein:

the controller calculates a first pixel correspondence index corresponding to said each pixel for reducing luminance of the backlight on the basis of the luminance information, and generates the output image signal using a second pixel correspondence index corresponding to the first pixel correspondence index for increasing luminance of said each pixel.

4. The display device according to claim 1, wherein:

the backlight includes a plurality of light sources that are configured to operate independently of one another; and the controller determines lighting patterns of the plurality of light sources so as to satisfy the required luminance value.

5. The display device according to claim 4, wherein:

the controller sets tentative lighting patterns of the plurality of light sources, generates, on the basis of the tentative lighting patterns and the luminance distribution information, tentative luminance distribution information at the time of driving the backlight using the tentative lighting patterns, corrects the tentative lighting patterns by comparing the tentative luminance distribution information with the required luminance value, and determines the lighting patterns.

6. The display device according to claim 5, wherein:

the luminance distribution information is stored by light source units with one light source or a combination of two or more light sources, of the plurality of light sources, as one light source unit; and the controller generates tentative luminance distribution information for each of the light source units on the basis of the tentative lighting patterns and the luminance distribution information for each of the light source units, and combines the tentative luminance distribution information for the light source units to generate the tentative luminance distribution information on an entirety of the backlight.

7. The display device according to claim 1, wherein:

the luminance distribution information includes luminance information on a representative pixel which represents pixels in a determined area of the display surface; and the controller generates luminance information for each pixel on the backlight by performing interpolation calculation using the luminance information of the representative pixel.

8. The display device according claim 1, wherein:

the backlight comprises a light guide plate and a plurality of light sources, and the plurality of light sources are arranged along a side of the light guide plate.

* * * * *